US006833518B1

(12) United States Patent
Byers et al.

(10) Patent No.: US 6,833,518 B1
(45) Date of Patent: Dec. 21, 2004

(54) LOAD TAP CHANGER WITH DIRECT DRIVE AND BRAKE

(75) Inventors: Christopher J. Byers, Waukesha, WI (US); Augusto D. Hernandez, Brookfield, WI (US); Dennis O. Conway, Milwaukee, WI (US); Neal Dirk, Whitefish Bay, WI (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 10/701,446

(22) Filed: Nov. 6, 2003

Related U.S. Application Data

(62) Division of application No. 09/841,182, filed on Apr. 25, 2001, now Pat. No. 6,693,247.
(60) Provisional application No. 60/210,486, filed on Jun. 9, 2000.

(51) Int. Cl.[7] ..... H01H 9/30
(52) U.S. Cl. ..... 200/11 TC; 323/341; 29/622
(58) Field of Search ..... 200/11 TC; 323/341; 307/139; 29/622, 592.1

(56) References Cited

U.S. PATENT DOCUMENTS

| | | | | |
|---|---|---|---|---|
| 3,153,188 A | | 10/1964 | McCarty | |
| 3,619,764 A | * | 11/1971 | Brennan | 323/341 |
| 3,652,812 A | * | 3/1972 | Ristuccia | 200/8 R |
| 4,061,963 A | | 12/1977 | Green | |
| 4,207,445 A | | 6/1980 | Hammar | |
| 4,533,797 A | * | 8/1985 | Kranich et al. | 200/11 TC |
| 4,595,806 A | | 6/1986 | Itoh | |
| 5,056,377 A | | 10/1991 | Yatchum et al. | |
| 5,191,179 A | | 3/1993 | Yatchum et al. | |
| 5,523,535 A | | 6/1996 | Larsson et al. | |
| 5,744,764 A | | 4/1998 | Aschenbrenner et al. | |
| 5,834,717 A | * | 11/1998 | Neumeyer et al. | 200/17 R |
| 6,060,669 A | | 5/2000 | Dohnal et al. | |
| 6,091,032 A | | 7/2000 | Dohnal et al. | |

OTHER PUBLICATIONS

McGraw–Edison, "Voltage Regulators", Jun. 1998, Cooper Power Systems, 225–10, pp. 1–8.
McGraw–Edison, "Tap Changer", Jun. 1998, S225–10–10, pp. 5–1 to 5–4.

* cited by examiner

*Primary Examiner*—K. Lee
(74) *Attorney, Agent, or Firm*—Fish & Richardson P.C.

(57) ABSTRACT

A rotary tap changer is connected to a power source to control voltage supplied from the power source to a load. The rotary tap changer includes a motor having an output device, and a drive sprocket having a drive shaft positioned perpendicularly to a plane of rotation of the drive sprocket. The rotary tap changer also includes a gear engaged by the drive shaft, a first set of movable contacts, and a transmission device. The first set of movable contacts is coupled to the gear and mounted to conductively engage taps of an electrical control device. The transmission device is coupled to the motor output device and to the drive sprocket such that the motor directly drives the first set of movable contacts for selecting an electrical control device tap.

10 Claims, 30 Drawing Sheets

LOAD TAP CHANGER WITH DIRECT DRIVE AND BRAKE

CROSS REFERENCE TO RELATED APPLICATIONS

This application is a divisional of U.S. application Ser. No. 09/841,182, filed Apr. 25, 2001, now U.S. Pat. No. 6,693,247, which claims the benefit of provisional 60/210,486 filed Jun. 9, 2000. The disclosure of the prior application is considered part of and is incorporated by reference in the disclosure of this application.

TECHNICAL FIELD

This invention relates to tap changers for use in electrical control devices such as voltage regulators and transformers that control the transfer of voltages to loads.

BACKGROUND

A typical electric distribution system includes a power source, such as a hydroelectric dam or a coal or nuclear fired generating station, a high voltage three-phase distribution system, and electrical control devices, such as voltage regulators or transformers, to control a distribution line voltage. For example, a transformer may be used to step down the distribution line voltage to a value acceptable to the end user. The transformer includes a high voltage primary winding, a secondary winding, and a magnetic core. The high voltage winding includes a wire wound in a series of wire loops around the core, the ends of which are connected to the high voltage distribution system. The secondary winding likewise includes a series of wire loops wrapped around the metal core. The secondary winding has far fewer wire loops than the high voltage winding. Thus, the voltage induced on the secondary winding is far lower than that on the high voltage winding. The secondary winding is connected to the ultimate local load distribution system.

Although the ratio of loops in the primary and secondary coil windings does not exactly match the ratio of input or primary voltage to output or secondary voltage, the correspondence is close enough to permit fine voltage regulation on the secondary voltage side of the transformer by making slight modifications in the number of secondary loops, or windings, which are in conductive engagement with the load. This is accomplished by placing a series of leads, or taps, in conductive engagement with the secondary winding at an evenly spaced number of windings apart. For example, if a ten percent variation is required, a tap is placed on the transformer secondary winding at approximately ten percent of the windings from the end of the secondary winding. Further refinement in that ten percent variation may be accomplished by further subdividing the final ten percent of the windings with additional taps.

Variations in the load on the secondary circuit can cause corresponding variations in the voltage in the secondary circuit. For example, if the load increases, the voltage in the secondary circuit will decrease. Likewise, load decreases in the secondary circuit will increase the voltage in the secondary circuit. Such variations in line voltage can be detrimental to the performance and life of industrial equipment, and annoying to residential electricity users.

A load tap changer is used to address the load voltage variation. A load tap changer is a device that employs a secondary circuit voltage detector to actuate a mechanical linkage to selectively engage the winding taps of a tapped section of a winding, in response to voltage variations, in order to control the output voltage of a transformer or voltage regulator while under load. The tap changer may be used for controlling the voltage of a single-phase voltage regulator or of a three phase transformer.

SUMMARY

In one general aspect, a rotary tap changer is connected to a power source to control voltage supplied from the power source to a load. The rotary tap changer includes a motor having an output device and a drive sprocket having a drive shaft positioned perpendicularly to a plane of rotation of the drive sprocket. The rotary tap changer also includes a gear engaged by the drive shaft, a first set of movable contacts, and a transmission device. The first set of movable contacts is coupled to the gear and mounted to conductively engage taps of an electrical control device. The transmission device is coupled to the motor output device and to the drive sprocket such that the motor directly drives the first set of movable contacts for selecting an electrical control device tap.

Implementations may include one or more of the following features. For example, the tap changer may include a motor sprocket attached to the motor output device. In that case, the transmission device couples to the motor output device through the motor sprocket. The drive sprocket has a first number of teeth and the motor sprocket has a second number of teeth such that a ratio of the drive sprocket number of teeth relative to motor sprocket number of teeth may be between 5:1 and 9:1. The gear may include a geneva gear. The drive sprocket and the gear may be configured such that a 360° rotation of the drive sprocket produces a 20° rotation of the gear. The transmission device may include a chain for engaging the drive sprocket teeth and the motor sprocket teeth.

The rotary tap changer may further include a first panel, a second panel positioned to be parallel with the first panel, and a support shaft. The support shaft is attached to the first panel and to the second panel to define an axis that is perpendicular to a plane of the first and second panels. The support shaft may support the gear. The rotary tap changer may also include a second shaft attached to the first panel to define a second axis that is perpendicular to the plane of the first and second panels such that the second shaft supports the drive sprocket.

The rotary tap changer may include a pivoting member coupled to a drive pin attached to the gear, a reversing switch configured to conductively engage a neutral tap and end taps of a tapped winding of the electrical control device through a second set of movable contacts mounted on the pivoting member to engage the reversing switch. The pivoting member may operate to select a polarity of a voltage from the electrical control device. The pivoting member may include a safety switch that trips open an electrical circuit that energizes the motor when the first set of movable contacts reaches a travel limit position. The motor may be prevented from re-energizing in a current direction of travel when the safety switch trips open the electrical circuit.

The rotary tap changer may further include a holding switch connected to the drive shaft and electrically connected to the motor. In this case, the rotary tap changer may include a control apparatus connected to the holding switch to send a signal through a first conductive path to the motor and to interrupt the signal through the first path when the holding switch closes to establish a second conductive path for selecting the electrical control device tap based on an output of the power source. The holding switch may be actuated by the drive shaft to maintain continuous power to the motor from another power source to ensure that the rotary tap changer completes a selection of the electrical control device tap after the control apparatus sends the signal to the motor. The other power source may be the power source that supplies voltage to the load. The holding switch may then be opened after a predetermined rotation of the drive shaft to de-energize the motor during selection of the electrical control device tap. The holding switch may be in series with the safety switch.

The drive sprocket may engage a device remote from the tap changer to indicate the selected electrical control device tap. The rotary tap changer may also include a second gear having an axis of rotation that is parallel to an axis of rotation of the drive sprocket and a pinion that rotates in response to rotation of the second gear to engage the device. The second gear would be engaged by an output shaft of the drive sprocket. The pinion may include a biasing device that engages the second gear to stabilize the second gear. The second gear may include a slot positioned on an outer perimeter such that the biasing device engages the slot to stabilize the second gear.

The first set of movable contacts may move from a first tap to a second tap in response to a variation in the voltage measured by a control apparatus coupled to the power source and to the load. The first set of movable contacts may move from the first tap to the second tap in a transfer time. The transfer time may correspond to one and a half cycles of a frequency of the power source. The movable contacts, motor, motor output device, drive sprocket, and the gear may be configured such that at least three current zeros occur during the transfer time. The transfer time may be less than one second or less than 500 milliseconds.

The rotary tap changer may also include a brake assembly coupled to the drive sprocket to stop the drive sprocket after the first set of movable contacts engages the electrical control device tap. The brake assembly may include a disc segment that is integral with the drive sprocket and rotates with the drive sprocket, and a stationary brake assembly. The stationary brake assembly may include brake lining strips opposing each other to define a plane that is coplanar with and centered on the disc segment. The brake lining strips may be placed under compression by a force and engage the disc segment when the disc segment passes between them. The brake lining strips may disengage the disc segment when the disc segment does not pass between them.

In another general aspect, a method of selecting a tap connected to an electrical control device for controlling voltage from a power source to a load includes receiving a signal from a control apparatus coupled to the power source to select a tap. The control apparatus couples to a motor having an output device. The motor is energized and the motor output device is rotated in response to the energization of the motor. The method includes providing a transmission device coupled to the motor output device and to a drive sprocket. The drive sprocket is driven with the transmission device in response to rotation of the motor output device. The method further includes rotating a gear in response to driving the drive sprocket, the gear engaging a first set of movable contacts. The first set of movable contacts is rotated in response to rotation of the gear to select the tap connected to the electrical control device.

The method may further include closing a holding switch connected to couple the power source to the motor to maintain continuous power to the motor from the power source to ensure that the tap is selected after the signal from the control apparatus is received. The holding switch is opened after a predetermined rotation of the drive shaft to de-energize the motor to select the electrical control device tap.

The method may also include actuating a pivoting member coupled to the gear to reverse a polarity of the tap section of a winding of the electrical control device. In that case, the method may include forming an anti-arcing bridge between a neutral tap and a second set of movable contacts connected to one end of a winding of the electrical control device. Additionally, the method may include de-energizing the motor when the first set of movable contacts reaches a travel limit position.

The method may include engaging the drive sprocket to prevent the drive sprocket from moving when the electrical control device tap is selected.

The method also includes actuating a device remote from the motor and the gear to indicate the selected electrical control device tap. Actuating the remote device may include engaging a second gear by an output shaft of the drive sprocket to rotate a pinion coupled to the remote device. The method may include stabilizing the second gear with a biasing device attached to the pinion and engaging a slot along an outer perimeter of the second gear.

The techniques and systems described here present improvements over existing load tap changers in several areas. Direct drive of the movable arcing contacts allows precise control of the transfer time from one contact to the next during a change in taps. Tap change motion is accomplished in a smooth fashion, thus avoiding impact to moving parts. A smooth transition is accomplished by storing kinetic energy in drive components to assist the motor during the change in taps. One of the advantages of the direct drive used in the tap changer is the ability to control a transfer time accurately by selecting the correct speed at which to drive the geneva gear.

A described braking system arrests the surplus kinetic energy stored in the electrical control device and stops the motion within a narrow range of angular travel of the drive components, after the tap change has been completed, without impact loads. A combination of a chain drive and geneva gear accomplishes the indexing motion of the movable contacts with simplicity and precision. In the tap changer described below, a complete tap change is accomplished in approximately 250 milliseconds for a 60 Hz AC source frequency. This fast response is beneficial during development and production where hundreds of thousands, or even millions, of testing operations are performed. A duration of a testing procedure performed on the improved tap changer is about one twentieth of the duration of a testing procedure performed with prior tap changers. For example, if prior load tap testing took about 80 days to complete, then testing for the improved load tap changer may take about 4 days to complete.

The tap changer results in longer arcing life of the contacts compared with prior tap changers in a target current range. The tap changer also provides a significant cost savings over prior tap changers. The tap changer is more reliable because of more efficient development and production. Additionally, the tap changer indexing mechanism is mechanically simpler and easier to service in the field when compared with prior tap changers.

The details of one or more implementations are set forth in the accompanying drawings and the description below. Other features and advantages will be apparent from the description, the drawings, and the claims.

DESCRIPTION OF DRAWINGS

Like reference symbols in the various drawings indicate like elements.

DESCRIPTION

Figure 1A:
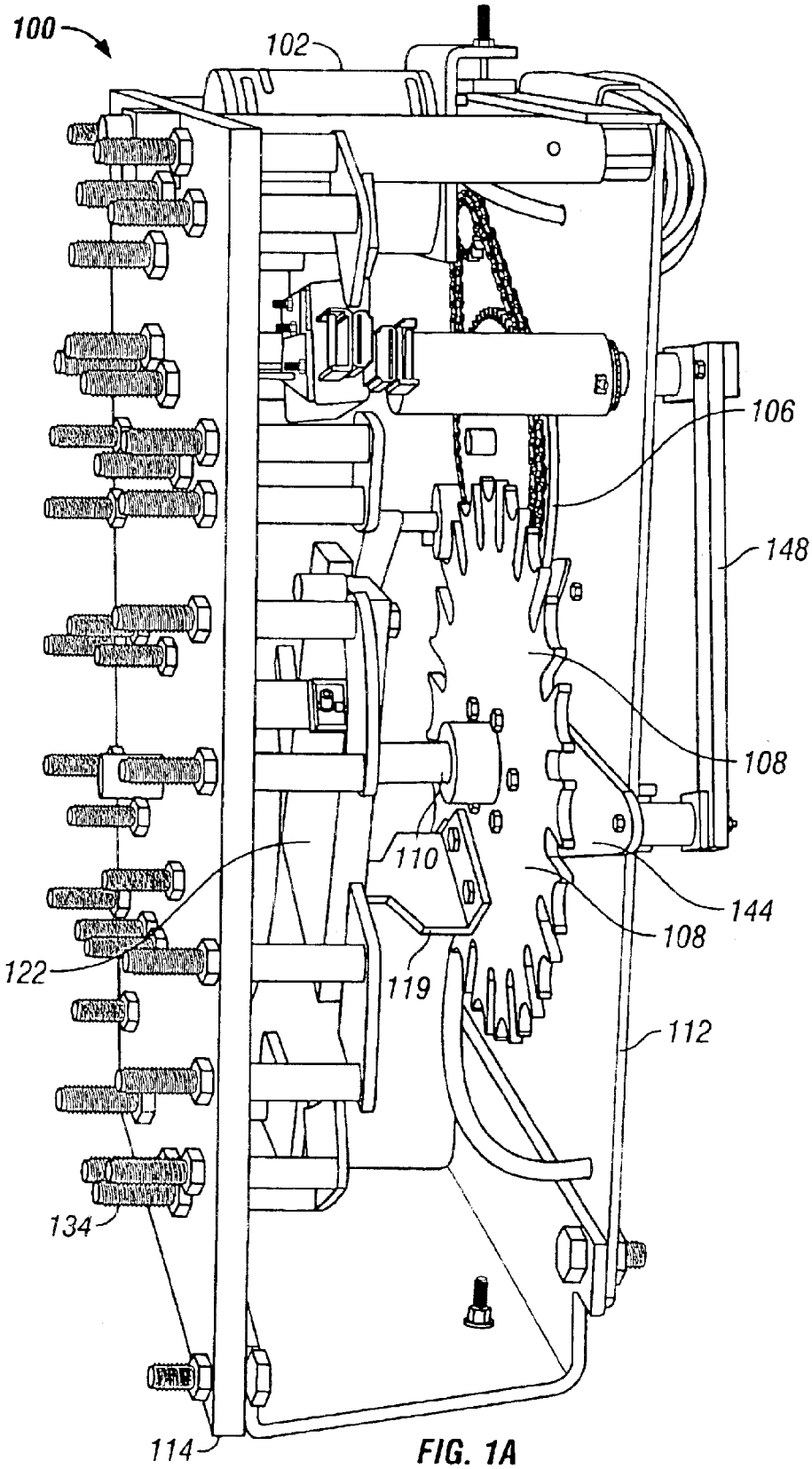
FIGS. 1A–F are perspective views of a load tap changer.
Figure 1B:
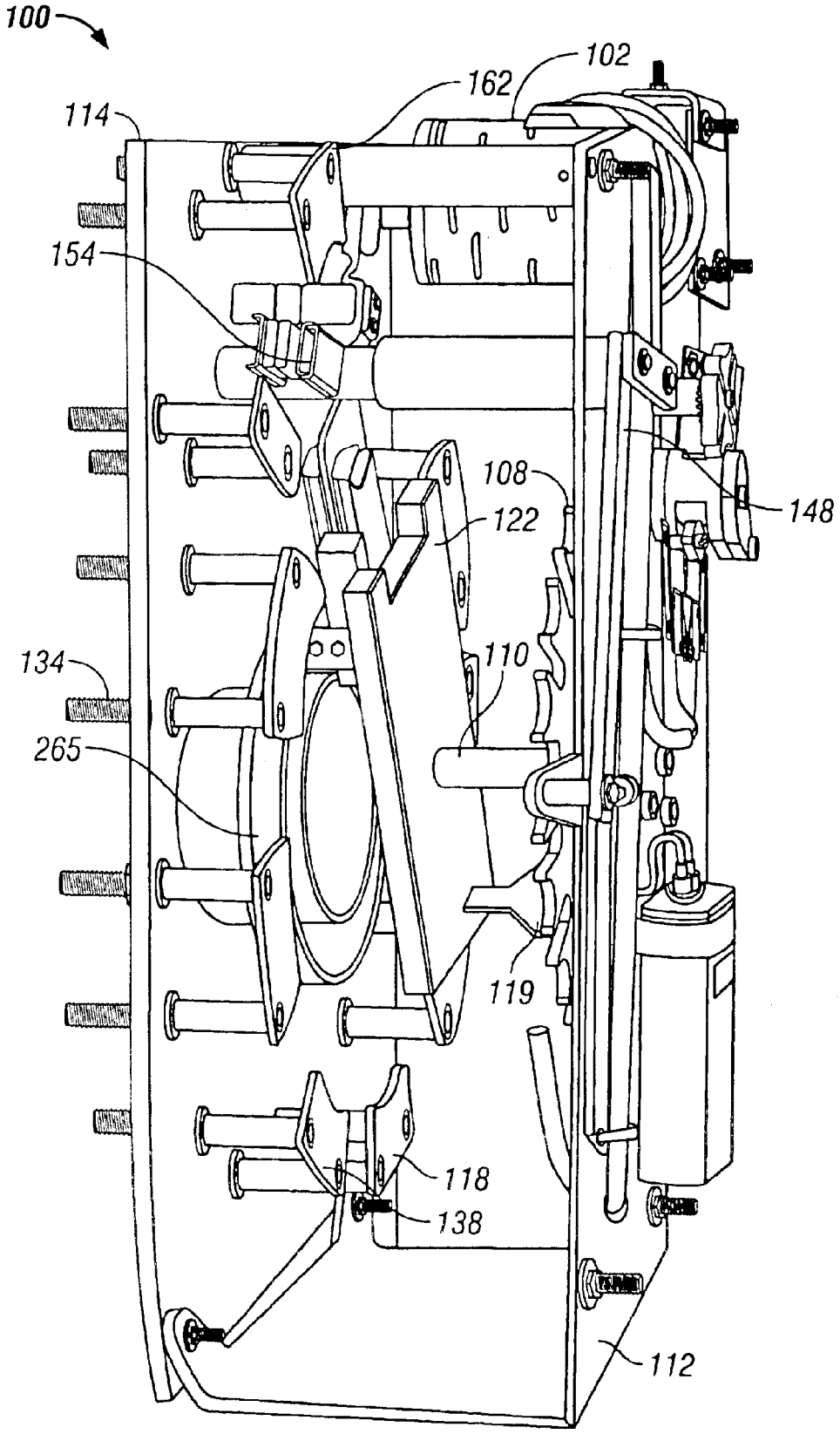
Figure 1C:
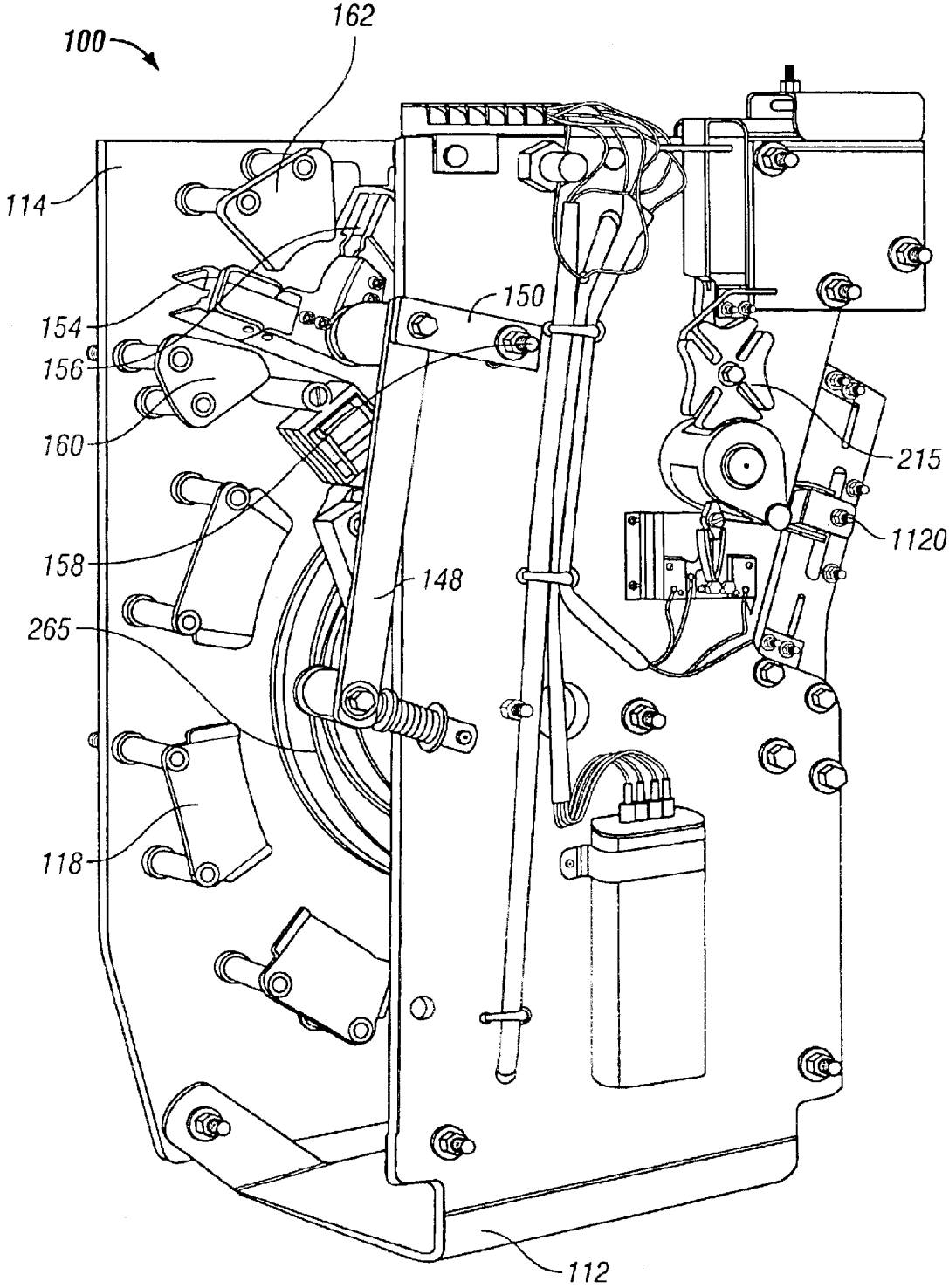
Figure 1D:
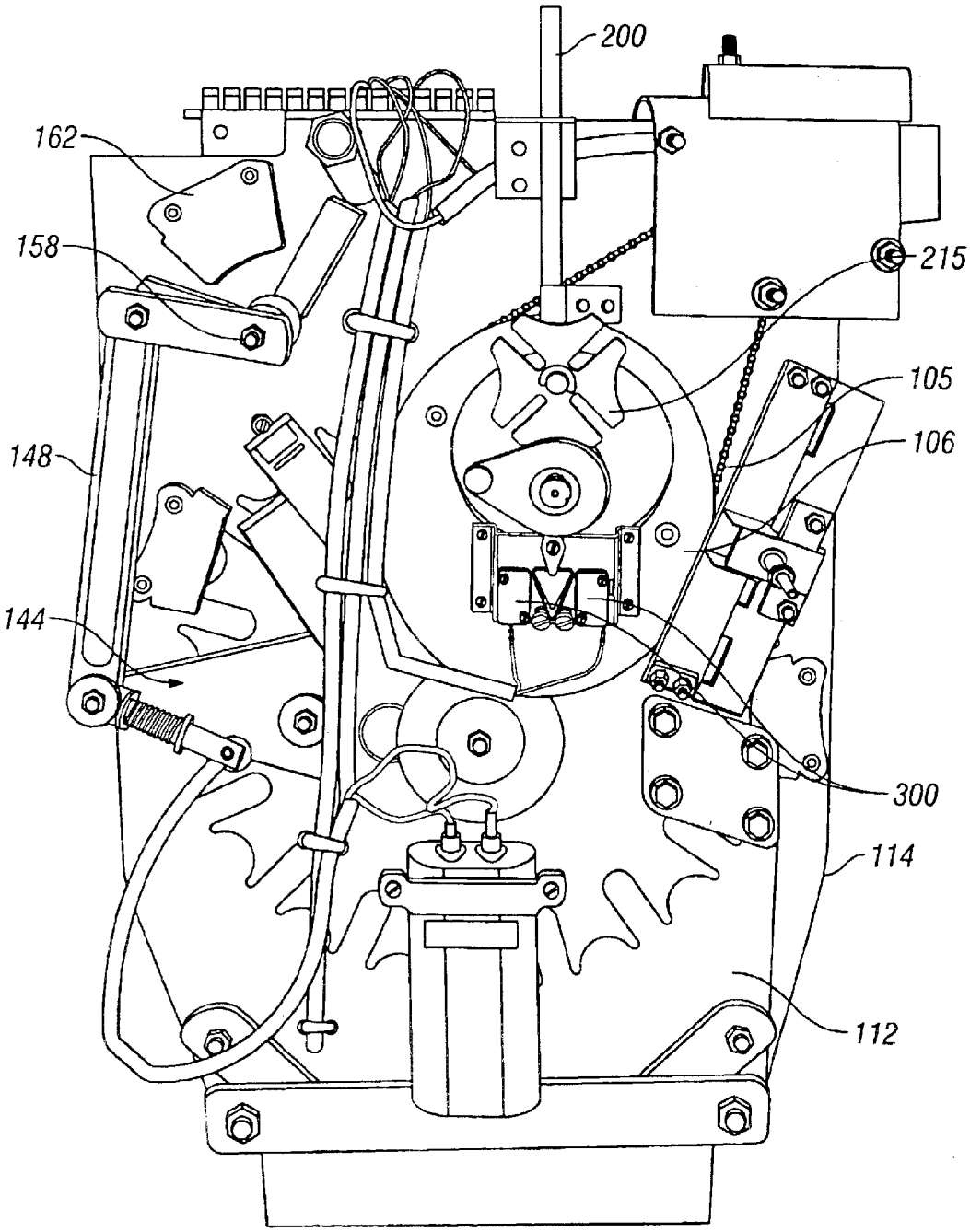
Figure 1E:
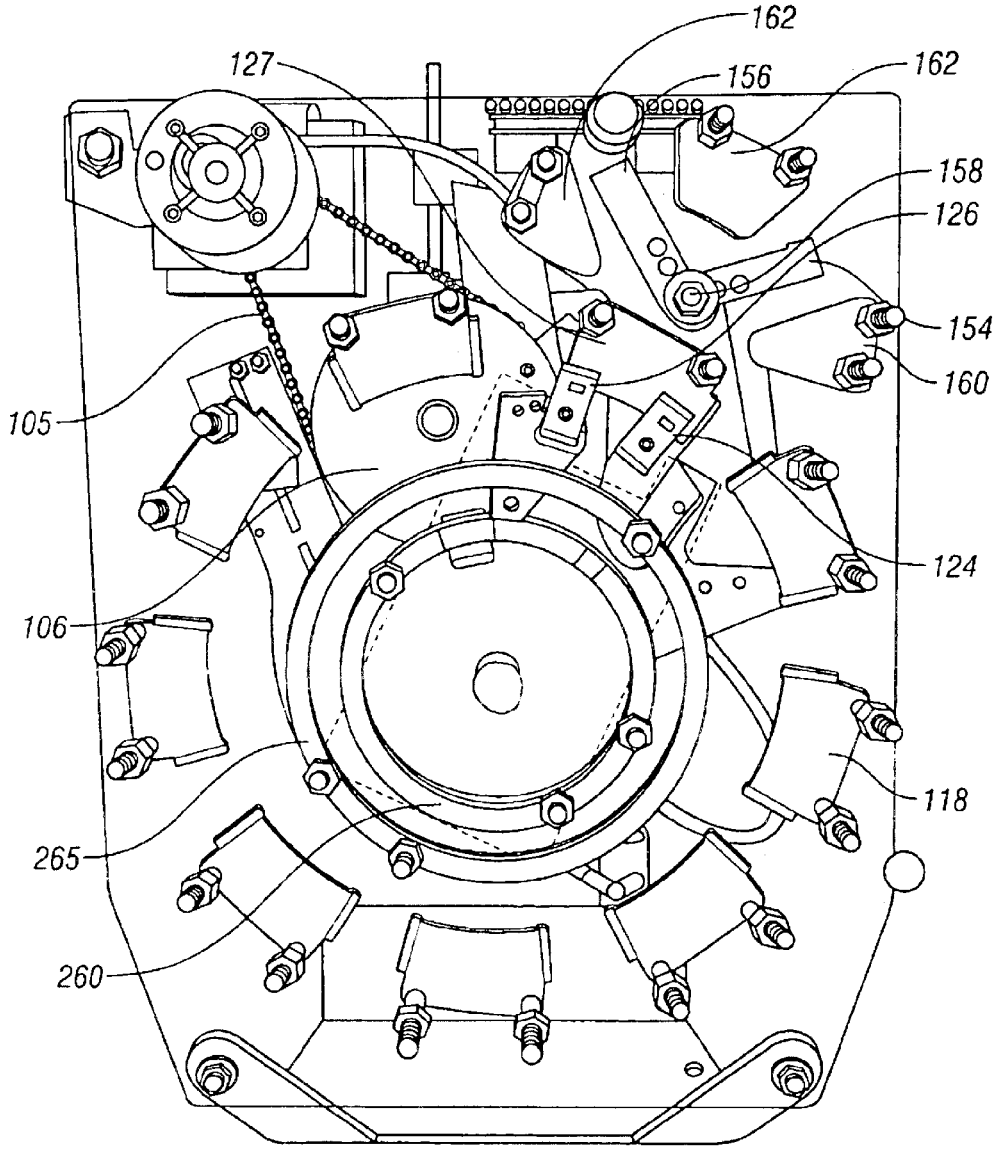
Figure 1F:
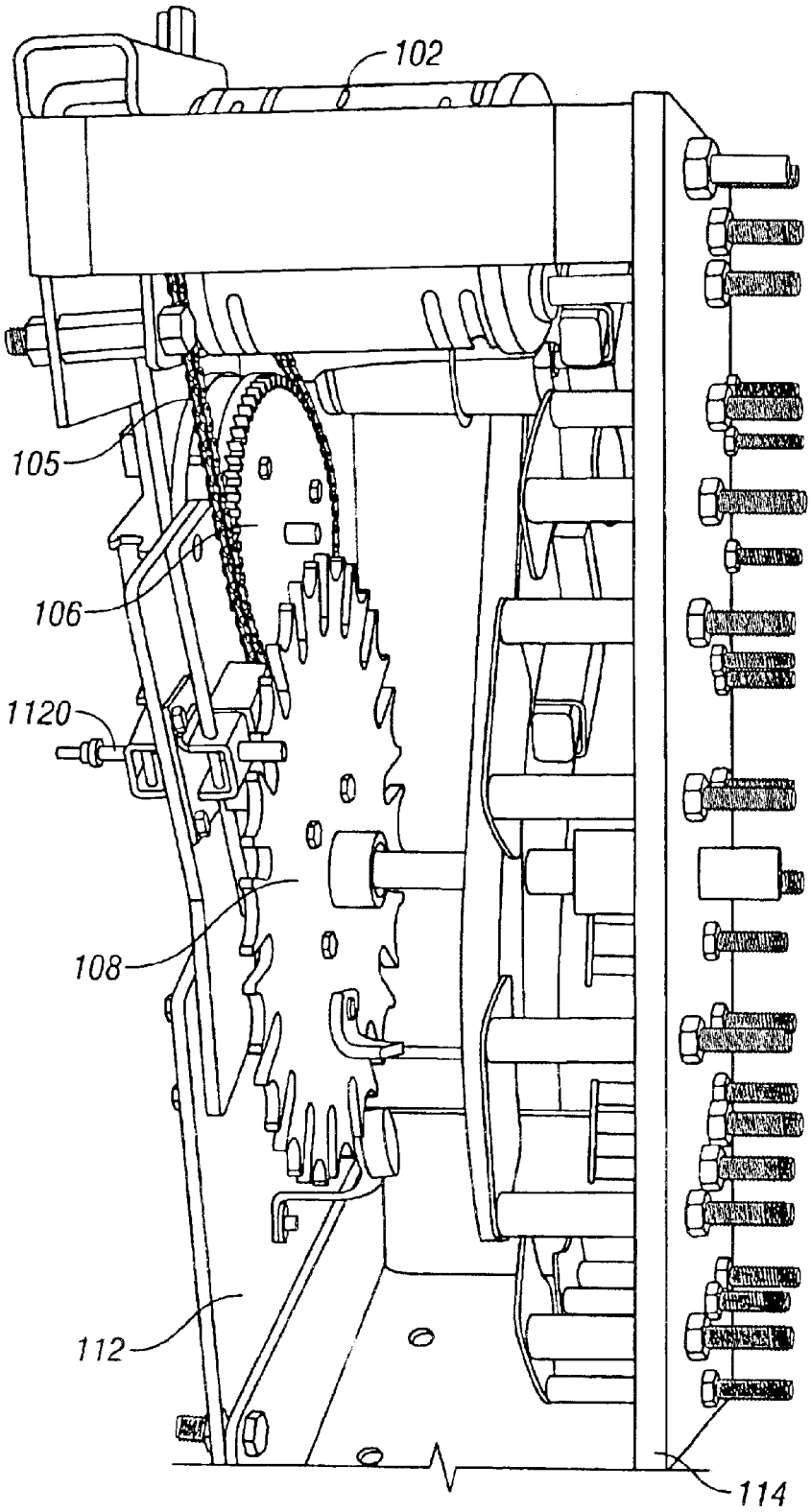
Figure 1G:
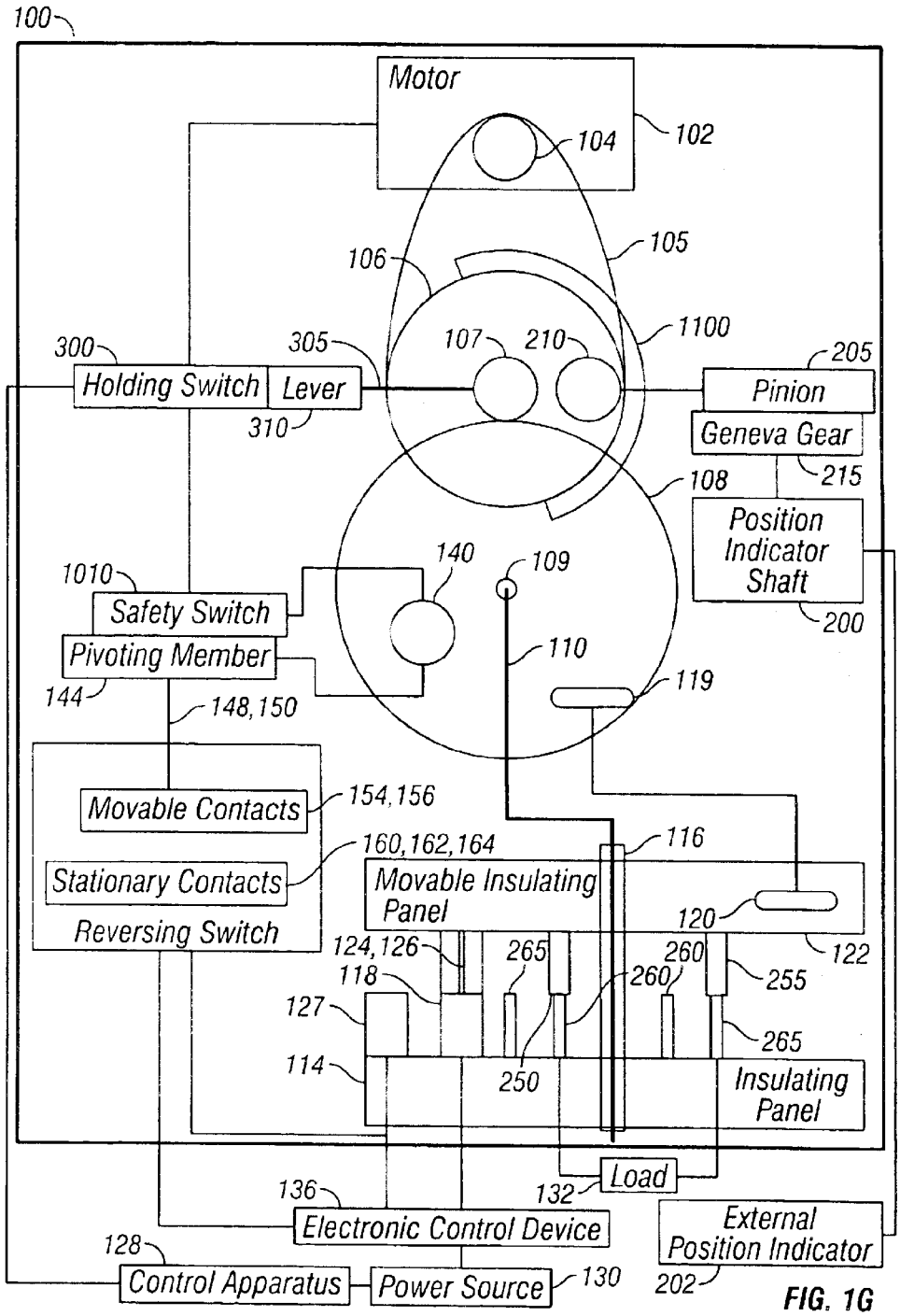
FIG. 1G is a block diagram of the load tap changer of FIGS. 1A–F.
Figure 1H:
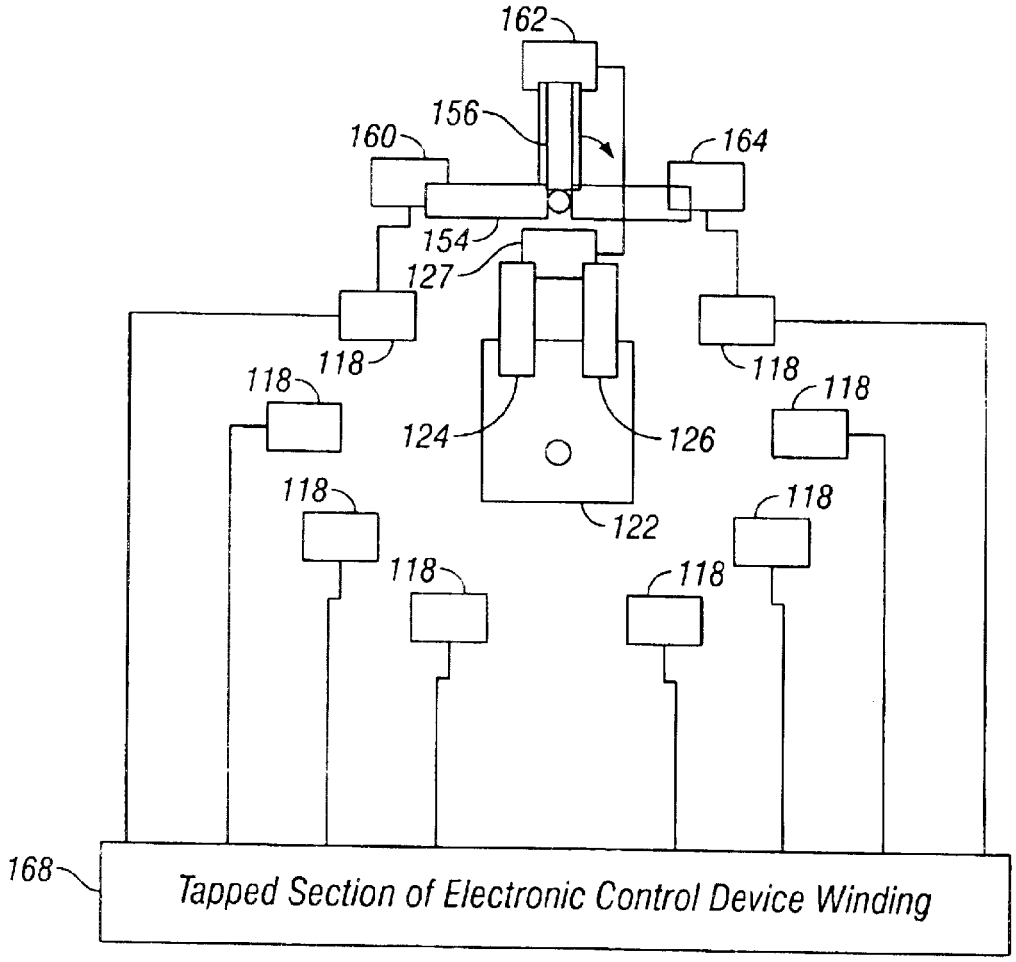
FIG. 1H is a circuit diagram of taps and contacts of the load tap changer of FIGS. 1A–F.
Figure 2A:
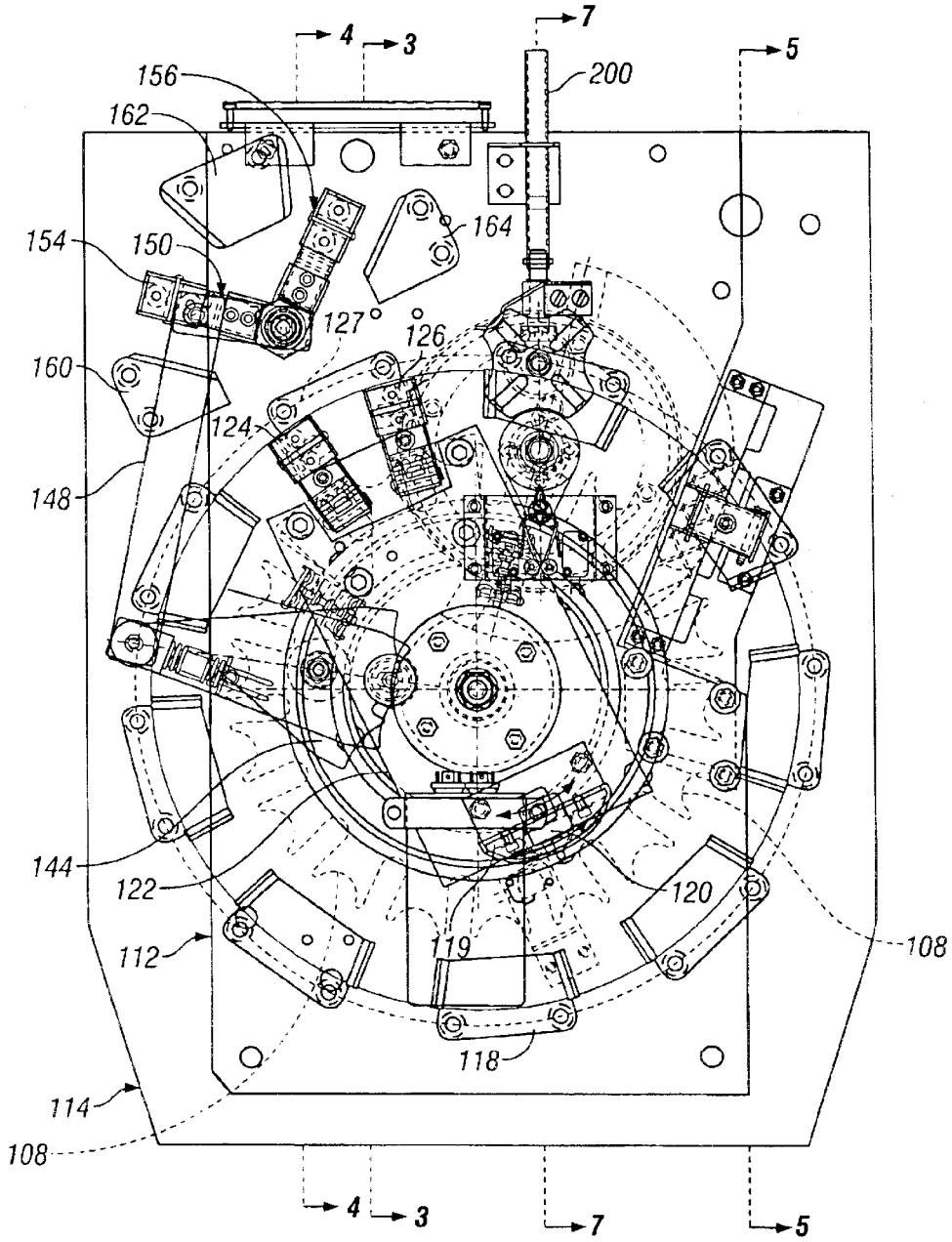
FIGS. 2A, 2B, 6A, and 6B are front cross-sectional views of the load tap changer of FIGS. 1A–F.
Figure 2B:
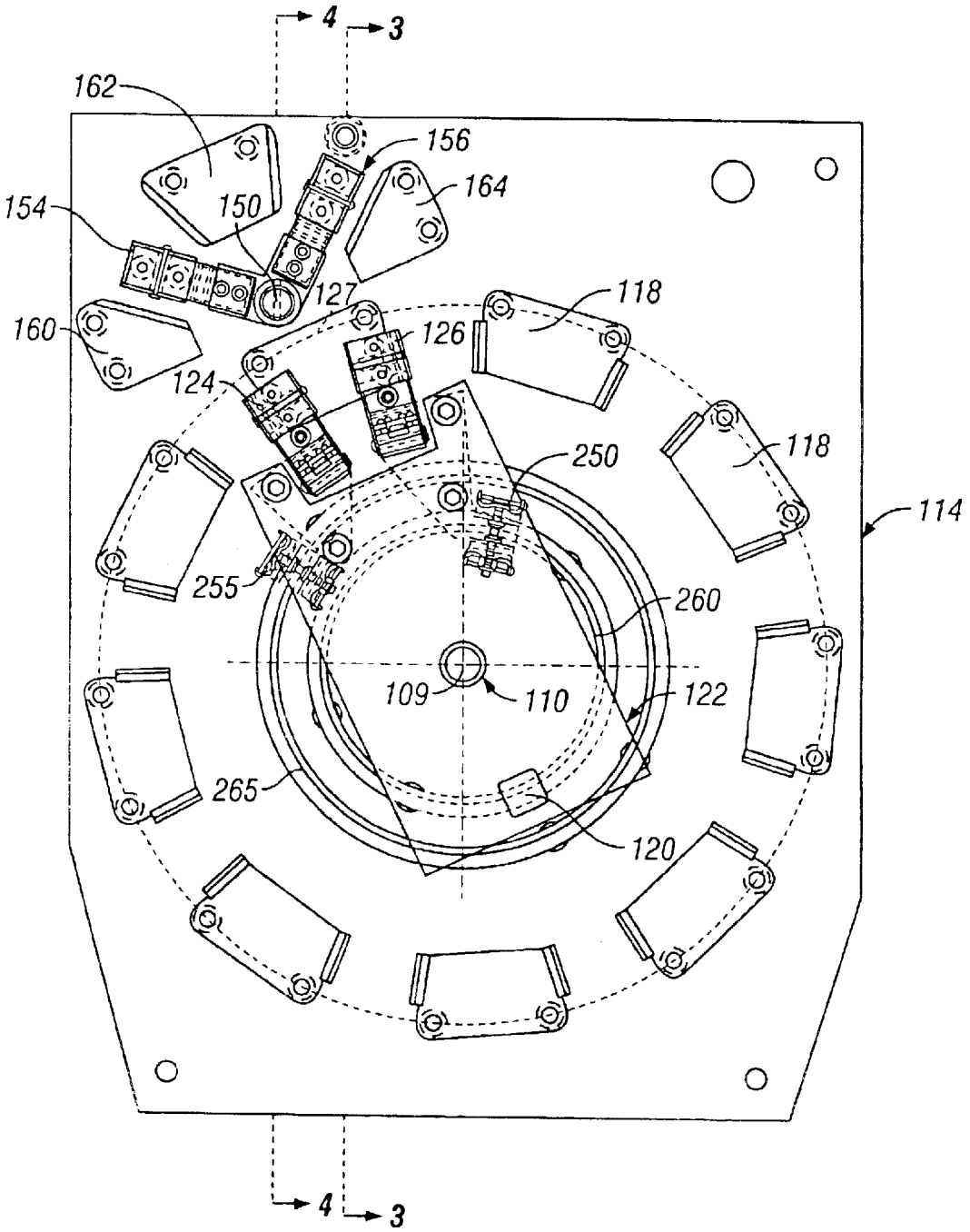
Figure 2C:
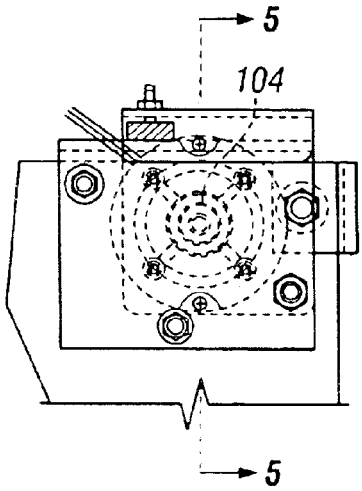
FIGS. 2C, 6C, 10A–C, and 11 are front cross-sectional views of portions of the load tap changer of FIGS. 1A–F.
Figure 7:
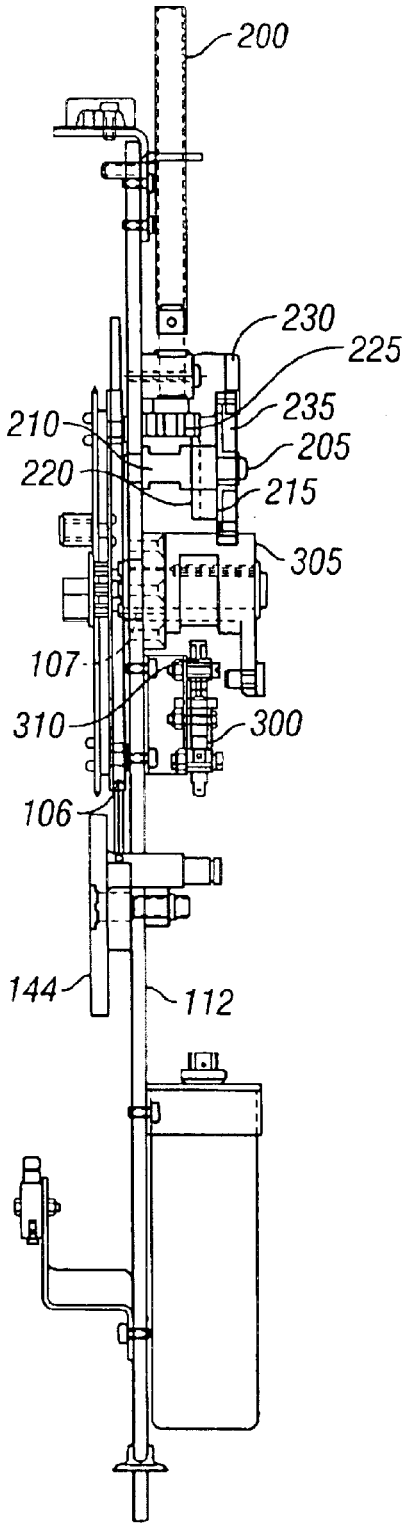
FIGS. 3–5 and 7 are side cross-sectional views of the load tap changer of FIGS. 1A–F.
Figure 3:
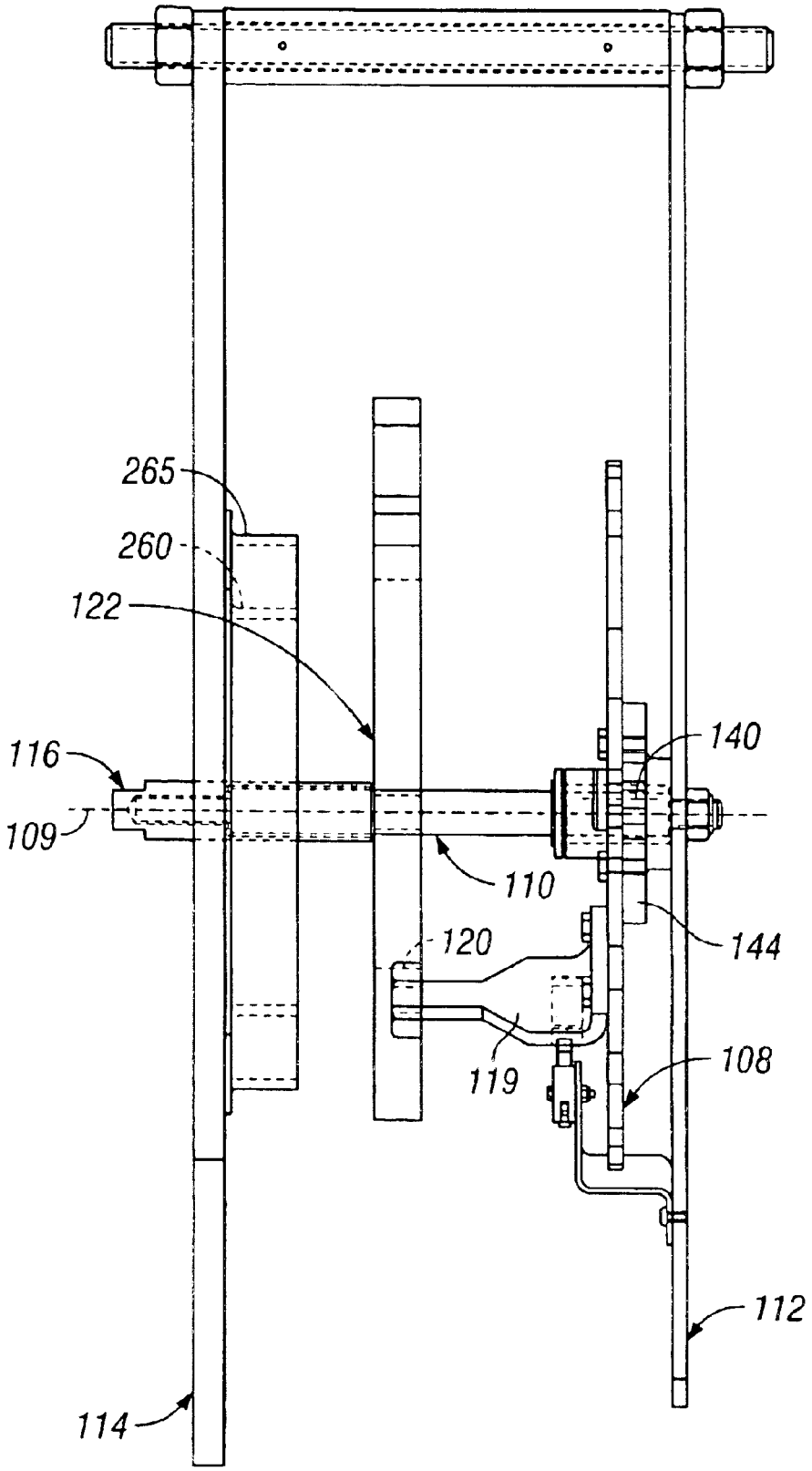
Figure 4:
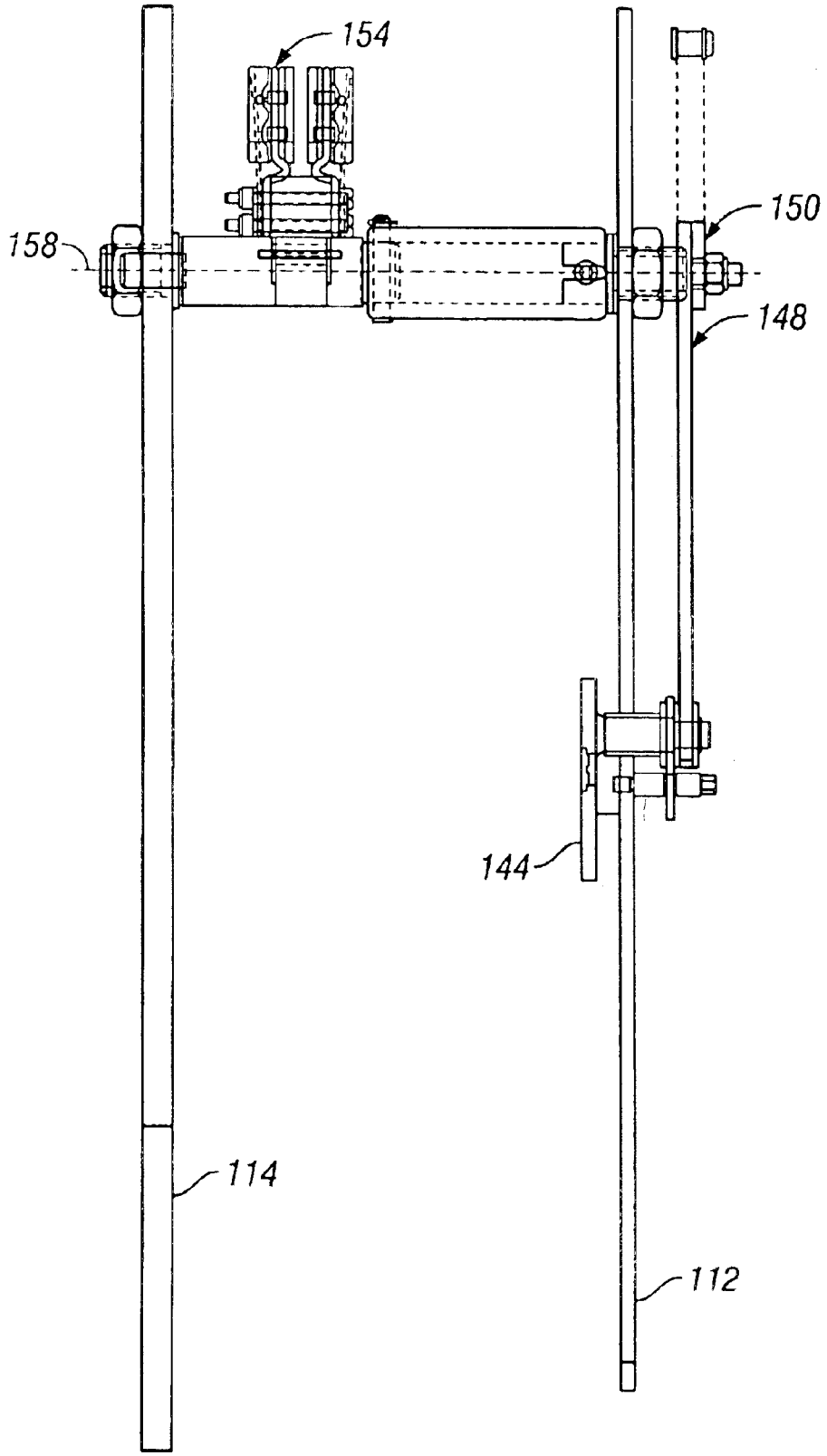
Figure 5:
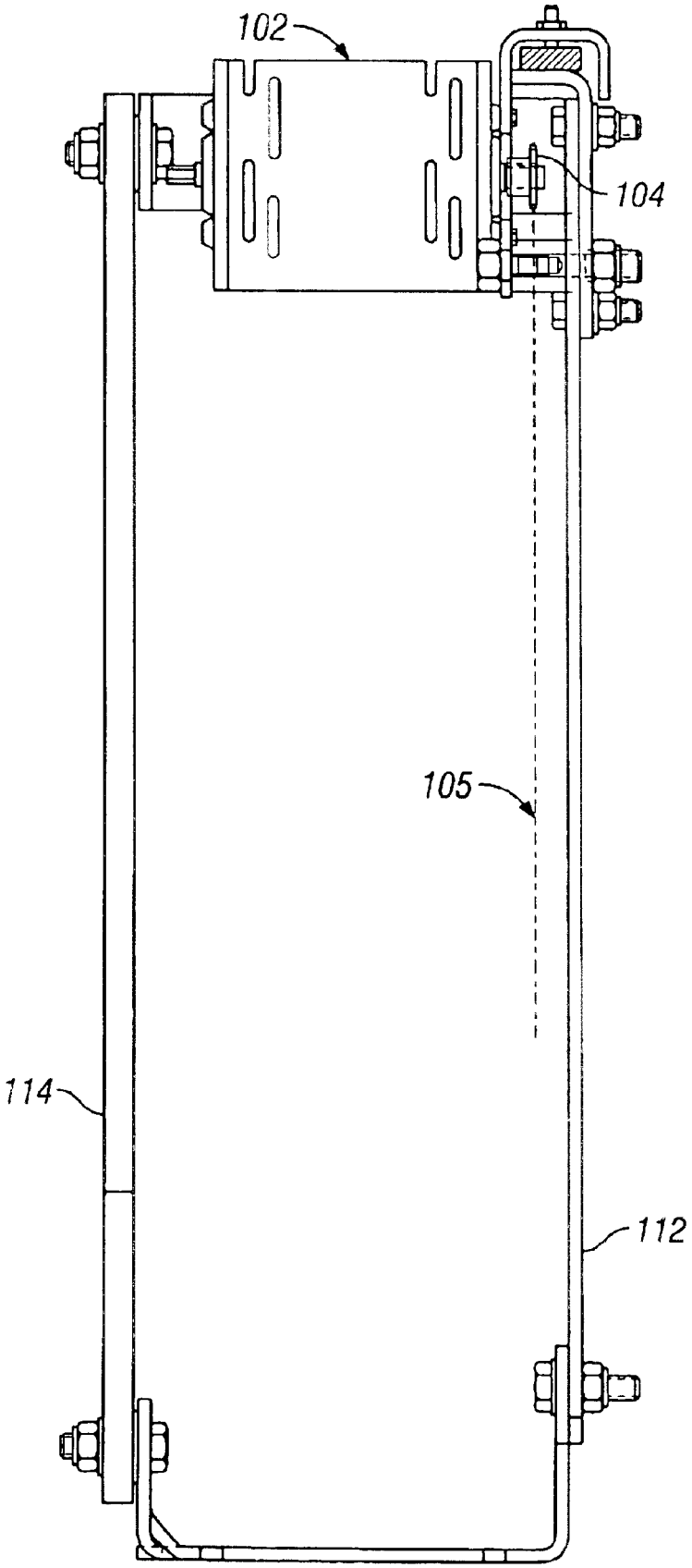
Figure 6A:
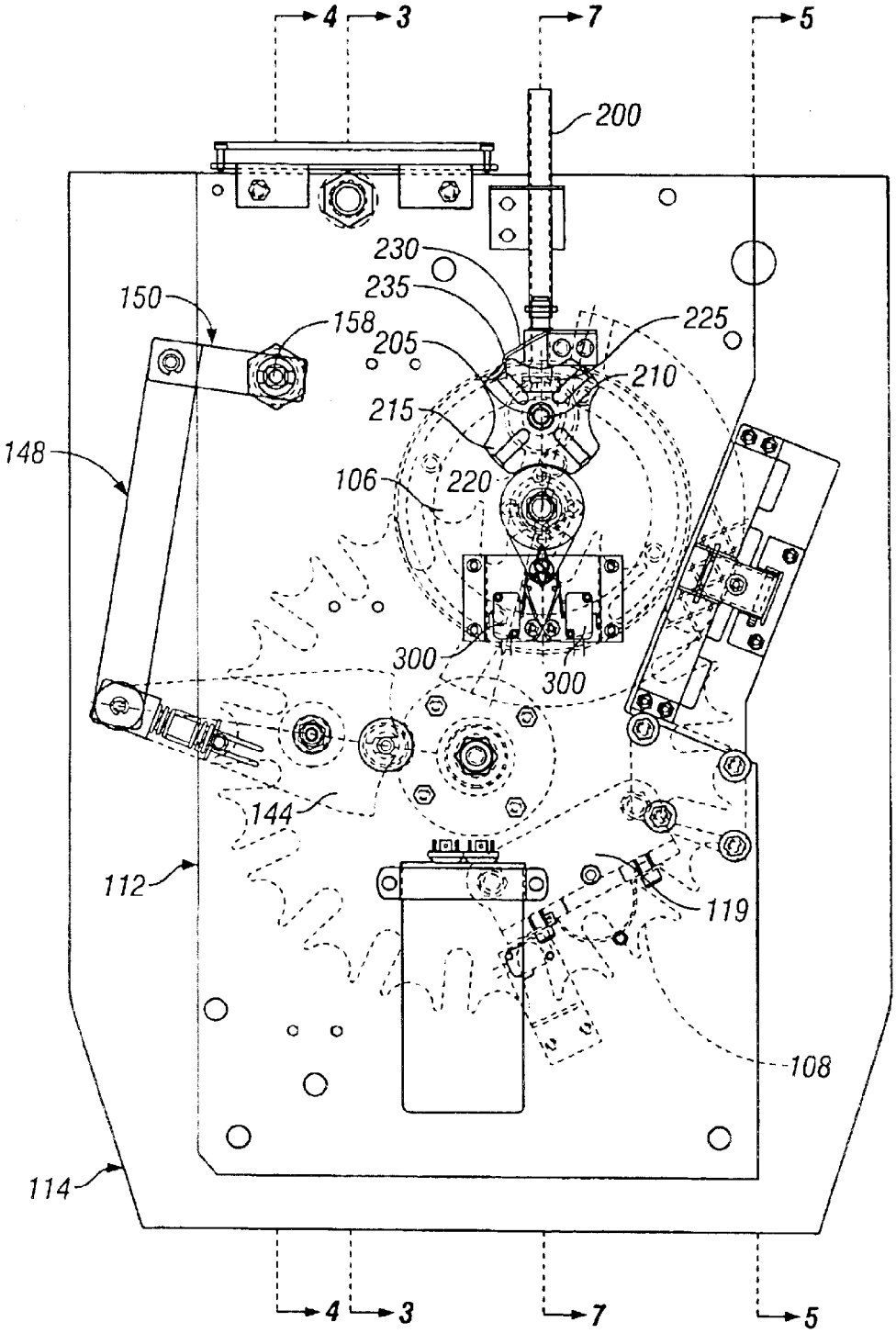
Figure 6B:
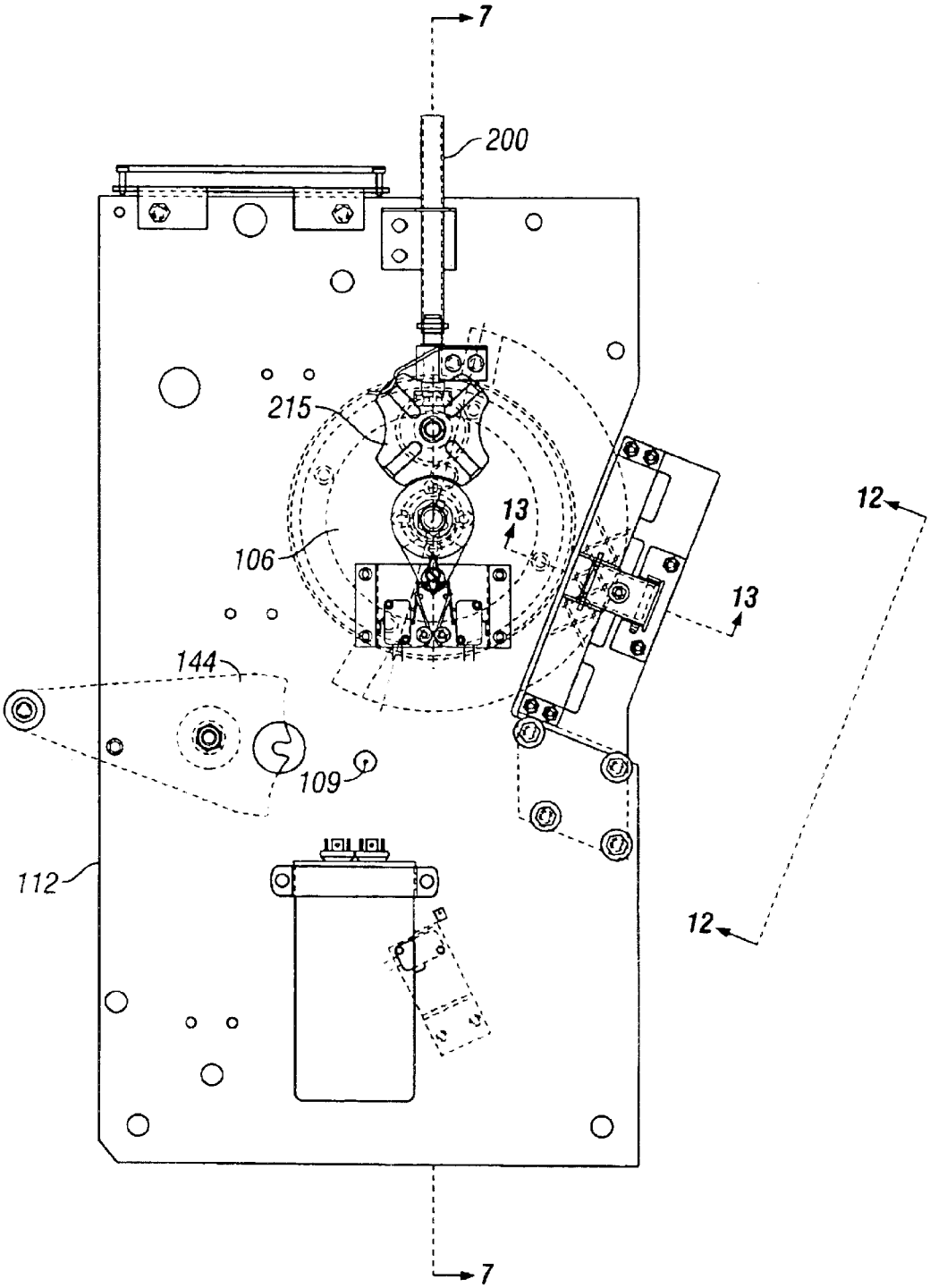
Figure 6C:
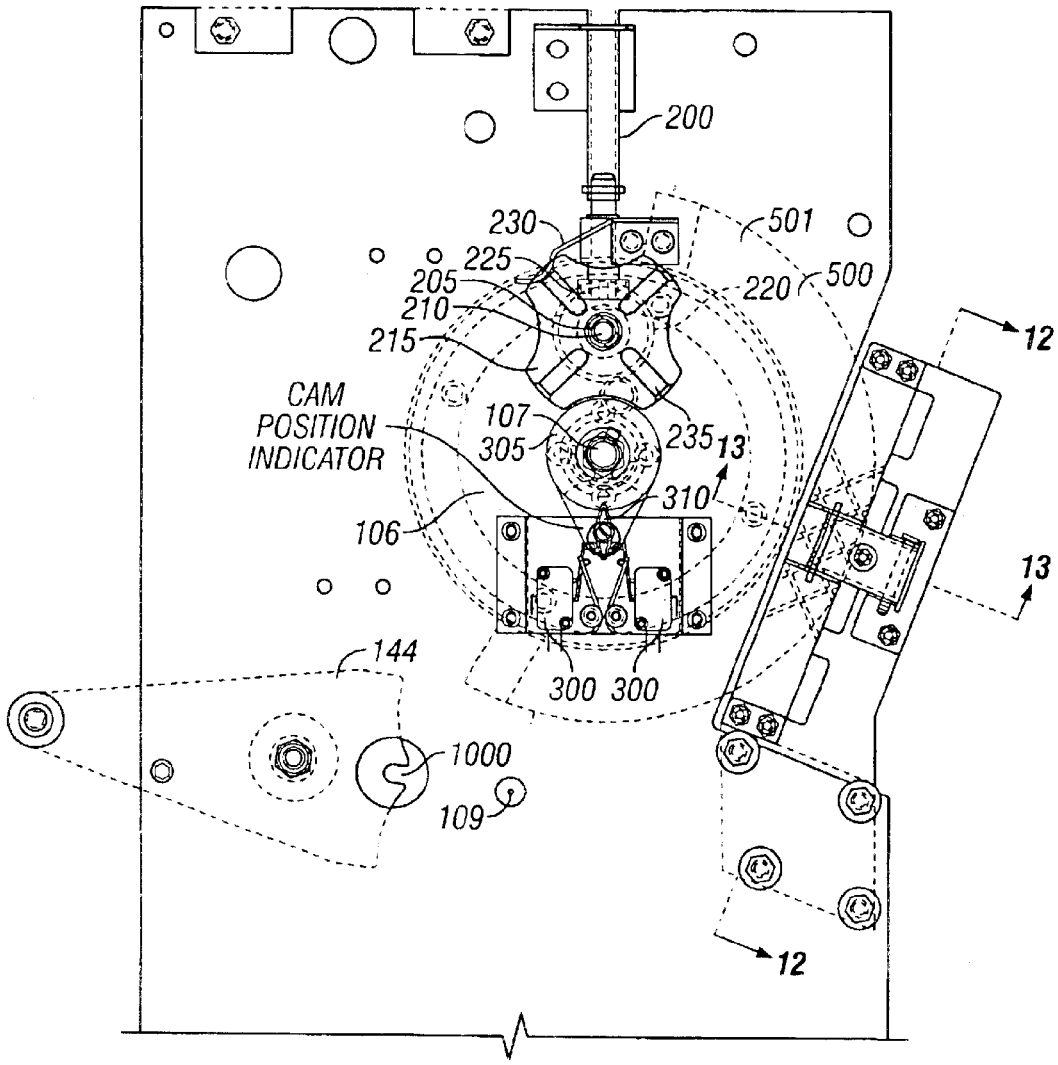

One common load tap selector is a rotary load tap changer. This is a mechanical device that selectively engages the winding taps of a tapped section of a winding. The rotary tap changer actuates a rotary tap arm coupled to a stationary selector dial such that the rotary tap arm conductively and mechanically engages stationary contacts, which are in turn conductively connected to the winding taps. One part of the rotary tap arm engages the contacts, while another part maintains engagement with a slip ring, which is wired to the load circuit.

The tap changer includes a rotary arm that supports a pair of electrical contacts. The rotary arm is rotationally connected to a geneva gear. The engagement of an electrical contact to a specific tap winding contact completes an electric circuit from the tap winding through slip rings to the load circuit on a phase. The tap changer stationary contacts are equally spaced and arcuately disposed in a circle about two concentric slip rings so that rotation of the rotary arm in specific arcuate steps creates an electrical path through the specific tap winding to the secondary circuit through the slip rings.

The rotary tap arm is driven between the stationary contacts in response to load variation. The load tap changer may vary the relationship between the input and output voltage of electrical control device by, for example, ±10% from a nominal value. For example, the load tap changer may include eight taps, each of which adjusts the relationship by 1.25%, such that the total possible adjustment may be up to 10% (that is, 8×1.25%). A polarity or reversing switch permits this adjustment to be positive or negative. In practice, the load tap changer may be used in applications providing voltage ratings between about 2400 volts and about 35,000 volts for 60 Hz and 50 Hz systems.

The load tap changer typically includes a set of identical parts to induce tap changes on each of the phases of a poly-phase circuit. For example, for a three-phase circuit, the load tap changer includes three identical parts, one for each phase of the circuit.

In practice, there are several different types of load tap changers currently in use. The design of the different load tap changers varies; with each design retaining some basic characteristics of load tap changers. For example, there are various methods of driving an indexing mechanism that controls the movable contacts such that the contacts move between fixed, indexed positions. There also are various methods of achieving the indexing motion of the movable contacts, interrupting the load, and selecting the winding taps. Some load tap changers make use of the same contacts for arcing duty and for tap selection, while others make use of separate contacts for each of these functions. Some load tap changers make use of vacuum interrupters to avoid arcing under oil. In general, each tap changer may be designed to optimize operation and cost for a particular application at certain current and voltage ranges.

One type of indexing arrangement (called a spring drive mechanism) makes use of energy stored in springs. The energy is slowly stored by deflecting the spring while the indexing mechanism is latched. Further travel of the drive releases the latch and allows the indexing device to drive the movable contacts to the next tap position. The force applied by the springs is predictable, but the speed of rotation of the contacts can depend on the loading induced by friction and other resistance to motion in the system. For example, the viscosity of the insulating fluid changes significantly with temperature. The transfer time can be optimized at a chosen temperature by adding dampers to slow the speed of rotation. At higher temperatures, the rotation may be faster. Moreover, at low ambient temperatures the speed can decrease considerably, which can result in longer arcing times.

Another disadvantage of the spring drive mechanism is the occurrence of impact resulting from stopping the inertia in the system after a tap change. Impact raises the loads applied to moving components, which may reduce mechanical life and may require reinforcement of the tap changer structure and the use of oversized chains and linkages to avoid early fatigue failures.

In prior load tap changers, the brake system, which serves to halt the movable contacts at the next tap position, is directly coupled to a motor that moves the movable contacts of the tap changer. Tap changers with such a brake system may take too long to stop the rotor, which may travel for more than one revolution after the motor is de-energized. These types of tap changers, like those tap changers using the spring drive mechanism, take as much as about 5 seconds to complete an indexing motion.

Referring to FIGS. 1A–H, 2A–C, and 3–5, an improved tap changer 100 includes a reversible induction motor 102 with an output device such as a sprocket 104 mounted to its output shaft and connected through a transmission device such as a transmission chain 105 to a drive sprocket 106. The drive sprocket 106 may, for example, have a tooth ratio of between approximately 5:1 and 9:1 relative to the sprocket 104. The drive sprocket 106 is attached to a drive shaft 107 that is oriented perpendicularly to the drive sprocket's plane of rotation and engages a geneva gear 108. The drive sprocket 106 and the geneva gear 108 are configured such that every 360° rotation of the drive sprocket 106 about its drive shaft 107 produces a 20° indexing rotation of the geneva gear 108.

The geneva gear 108 is supported at its center of rotation 109 by a steel shaft 110 that is supported at its ends by a support steel plate 112 on one side and an insulating dial switch panel 114 on the other. One end of the central steel shaft 110 is electrically grounded at an end of the steel plate 112. Another end of the central steel shaft 110 is in intimate contact with an insulating sleeve 116 that passes through the insulating panel 114. The insulating sleeve 116 provides a longer electrical creep distance to stationary contacts 118 on the insulating panel 114.

The geneva gear 108 is firmly attached to a bar 119 that extends perpendicularly to the plane of rotation of the geneva gear 108 (and parallel to the center of rotation 109). The bar 119 engages a drive slot 120 in the rotary arm, which includes a movable insulating panel 122. The movable insulating panel 122 is supported by and rotates around the common steel shaft 110 that supports the geneva gear 108. The insulating panel 122 has the drive slot 120 at one end and at the other end supports two electrical movable contacts 124, 126 positioned such that their center lines form a pre-defined angle with the center of rotation 109 (at the geneva shaft 110), with the pre-defined angle being, for example 20°.

The stationary contacts 118 are disposed radially on and are supported by the insulating dial switch panel 114. The stationary contacts 118 are uniformly spaced around the center of rotation 109 (at the geneva shaft 110) at an angle that is twice as large as the angle subtended by the movable contacts 124, 126. For example, if the angle subtended by the movable contacts 124, 126 is 20°, then the stationary contacts 118 are spaced by 40°. One of the stationary contacts 118 is a neutral tap contact 127.

The motor 102 couples to a control apparatus 128 that monitors an AC value (such as voltage or current) of an AC source 130 that supplies power to a load 132. For example, the control apparatus 128 may connect to a current transformer electrically connected to the AC source 130 to monitor AC current levels. Each stationary contact 118 has an end 134 that electrically connects to a tap lead (not shown) of an electronic control device 136 that receives power from the power source 130 to control an AC value to the load 132. The stationary contact 118 has a surface (or blade) 138 at another end that lies perpendicular to the center of rotation 109 and is disposed in a plane that is coplanar with the other stationary contacts 118. The surface 138 of the stationary contact 118 is engaged by the movable contacts 124, 126 in a predetermined sequence.

The geneva gear 108 also has a drive pin 140 attached to a side of the geneva gear 108 facing panel 112. The drive pin 140 engages pivoting member 144. The drive pin 140 is disposed at a pre-established angle relative to the movable contacts 124, 126 to engage the pivoting member 134 at a precise point in the indexing motion.

The pivoting member 144 is connected by linkages 148, 150 to movable contacts 154, 156. The movable contacts 154, 156 pivot about an axis 158 centered about stationary contacts 160, 162, 164. The movable contacts 154, 156 and stationary contacts 160, 162, 164 constitute a reversing switch for reversing the polarity of the winding tap section relative to a shunt winding to add to or subtract from the shunt winding voltage. When the tap changer 100 is in a neutral position, the reversing switch is not in contact with the stationary contacts 160, 162, 164. The reversing switch is actuated twice for each full revolution of the geneva gear 108; namely, first upon engagement of the neutral tap contact 127, and second upon a changing polarity of winding tap section 168.

Contacts 162 and 127 are electrically connected (by a jumper not shown) and therefore are at the same voltage. The reversing switch connects stationary contact 162 to either stationary contact 160 or 164. The stationary contacts 160 and 164 are each connected to one end of the winding tapped section 168. The neutral tap contact 127 and stationary contact 162 are located such that there is a nominal voltage across the contacts 127, 162 and the end of the winding tapped section 168. The reversing switch connects the contacts 160 or 164 to the neutral tap contact 127. Thus, indexing motion of the movable contacts 124, 126 causes that portion of the winding tapped section to add or subtract from the nominal voltage.

For example, the neutral tap contact 127 may be located at ten percent of the windings from the end of the device 136. This configuration permits sixteen voltage changes in each direction for a total of thirty-two stepped voltage changes and a total percentage variation of twenty percent. In moving from a first position back to a neutral position, the reversing switch is flipped. Each reverse step, while the reversing switch is located to link the taps on the high side of the neutral tap, results in an output voltage reduction.

The movable insulating panel 122 also retains a set of inner contacts 250, 255 that have continuous electrical contact with, respectively, inner slip ring 260, and outer slip ring 265, which are attached to the insulating panel 114.

Referring also to FIGS. 6A–C and 7, the load tap changer 100 also includes a mechanism for actuating a shaft 200 for driving a position indicator 202 located remote from the tap changer 100 and outside of a containing tank (not shown). The panel 112 includes an output shaft 210 that attaches to a pinion 205 for attaching a geneva gear 215. The geneva gear 215 is engaged by a cam 305 (discussed below) of the drive shaft 107 of the drive sprocket 106 such that the geneva gear 215 rotates along with the drive sprocket 106. For example, if the geneva gear 215 has four recesses that engage the drive shaft 107, then the geneva gear 215 rotates 90° for each 360° rotation of the drive sprocket 106.

The geneva gear 215 has an integral face gear 220 driving a second pinion 225 attached to the shaft 200. The second pinion 225 has a tooth ratio of 1:2 with the face gear 220 so that its shaft 200 rotates 180° for each indexing motion of the main electrical contacts 124, 126.

The pinion 225 includes a biasing device 230 that is positioned to act on the geneva gear 215. The biasing device 230 centers the geneva gear 215 so that the geneva gear 215 does not rotate when it loosens, which may happen during travel. Loosening of the geneva gear 215 often prevents the cam 305 of the drive sprocket 106 from entering the recess of geneva gear 215. The biasing device 230 locks into an outer slot 235 of the geneva gear 215 whenever the outer slot 235 passes across the biasing device 230.

Figure 8:
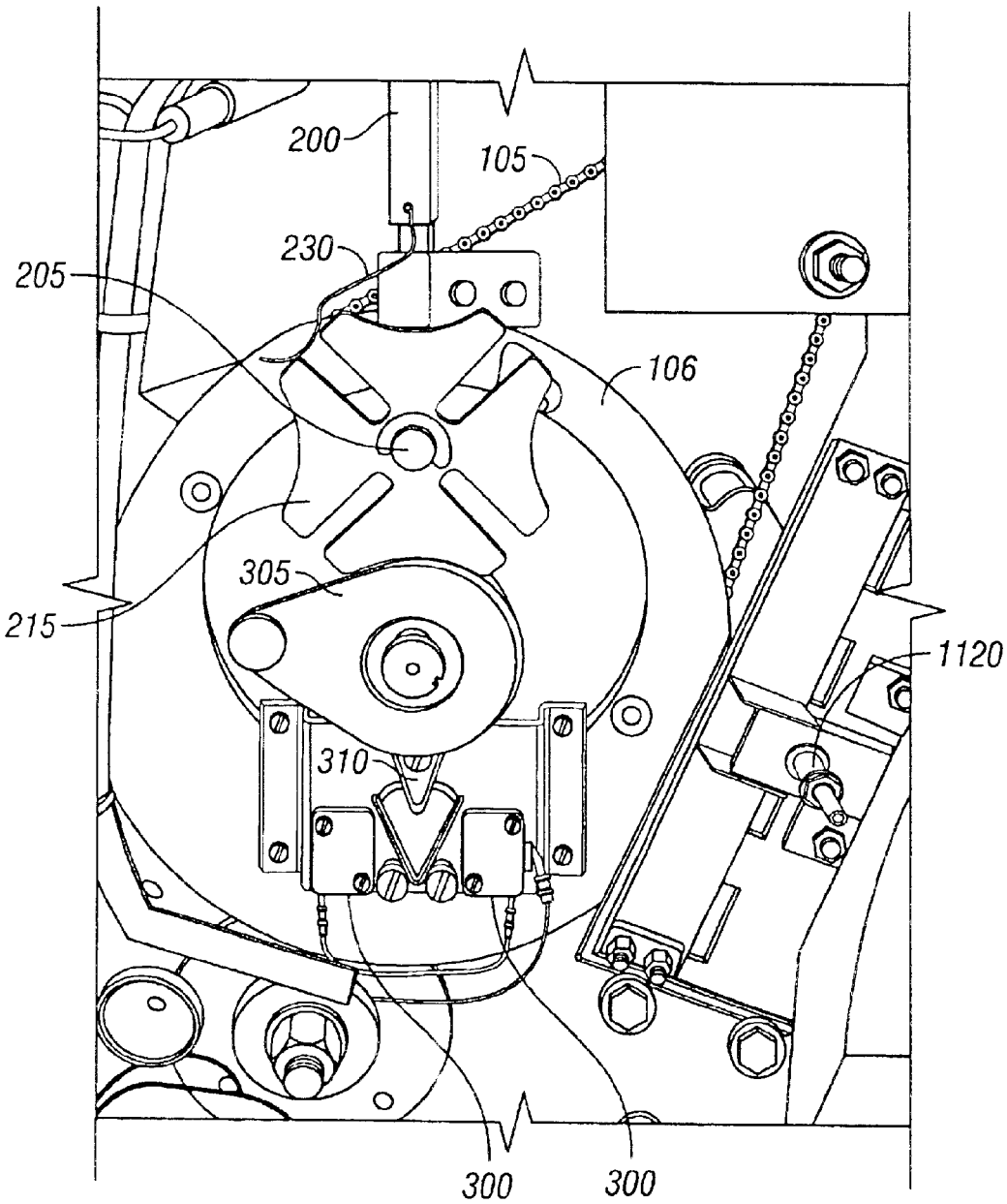
FIGS. 8 and 9 are perspective views of portions of the load tap changer of FIGS. 1A–F.
Figure 9:
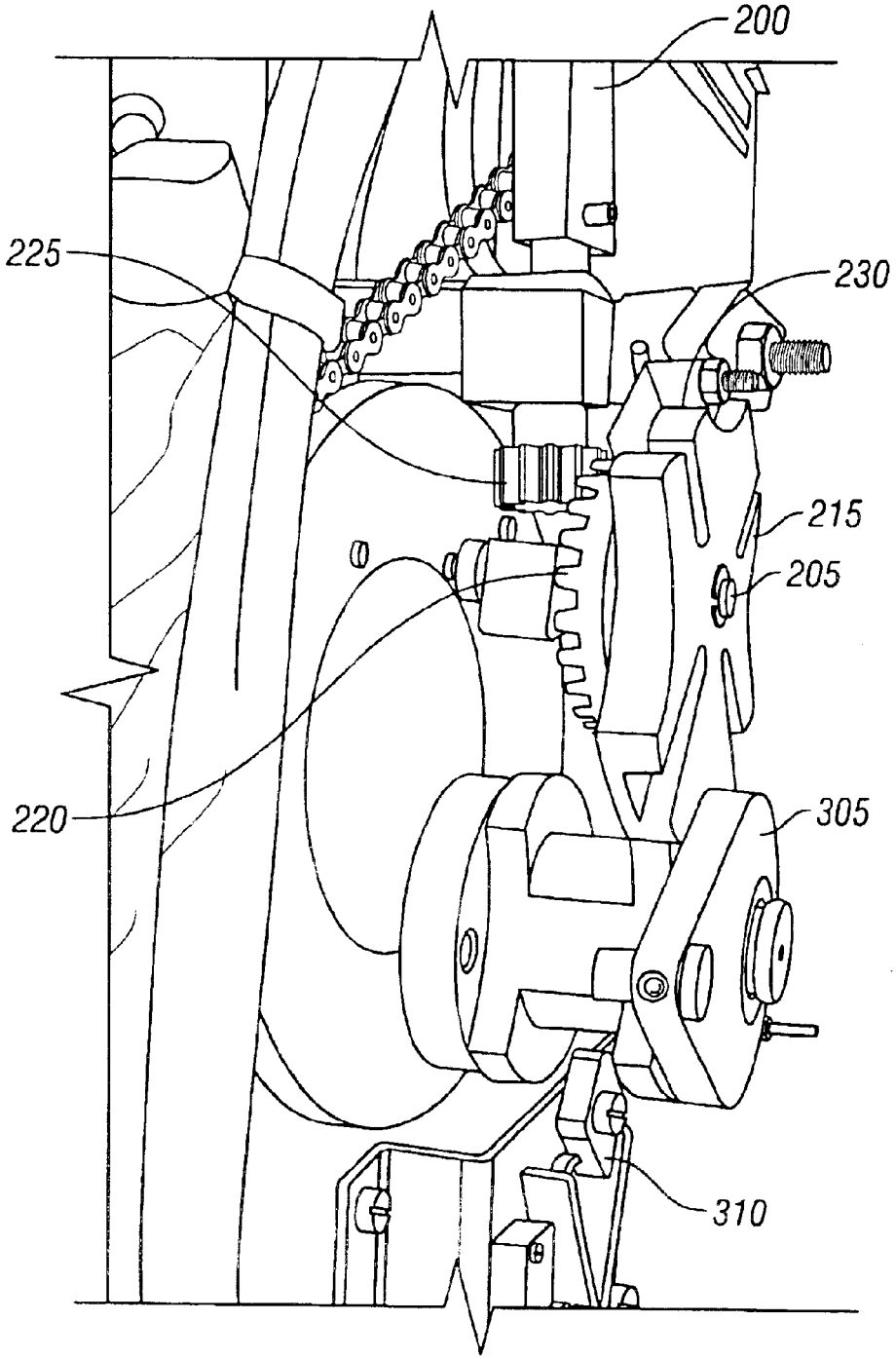

Referring also to FIGS. 8 and 9, the tap changer 100 also includes a set of directional holding switches 300 that couple the power source 130 to the motor 102. Each directional holding switch 300 is actuated from the drive shaft 107. Cam 305 actuates a lever 310, which then operates the directional holding switches 300. The directional holding switch 300 closes a parallel circuit shortly after a control signal from the control apparatus 128 initiates a tap change, thus maintaining continuous electrical power to the motor 102 to ensure that once started, the indexing motion is completed. When the control apparatus 128 senses that the holding switch 300 is closed, it interrupts the initial signal to the motor 102. The motor 102 continues to be energized through the holding switch only. Further angular travel of cam 305 releases lever 310, which then opens the holding switch 300. The motor 102 is thus de-energized after a precise angular travel, which insures both completion of the indexing motion and a single tap change per control signal.

Figure 10A:
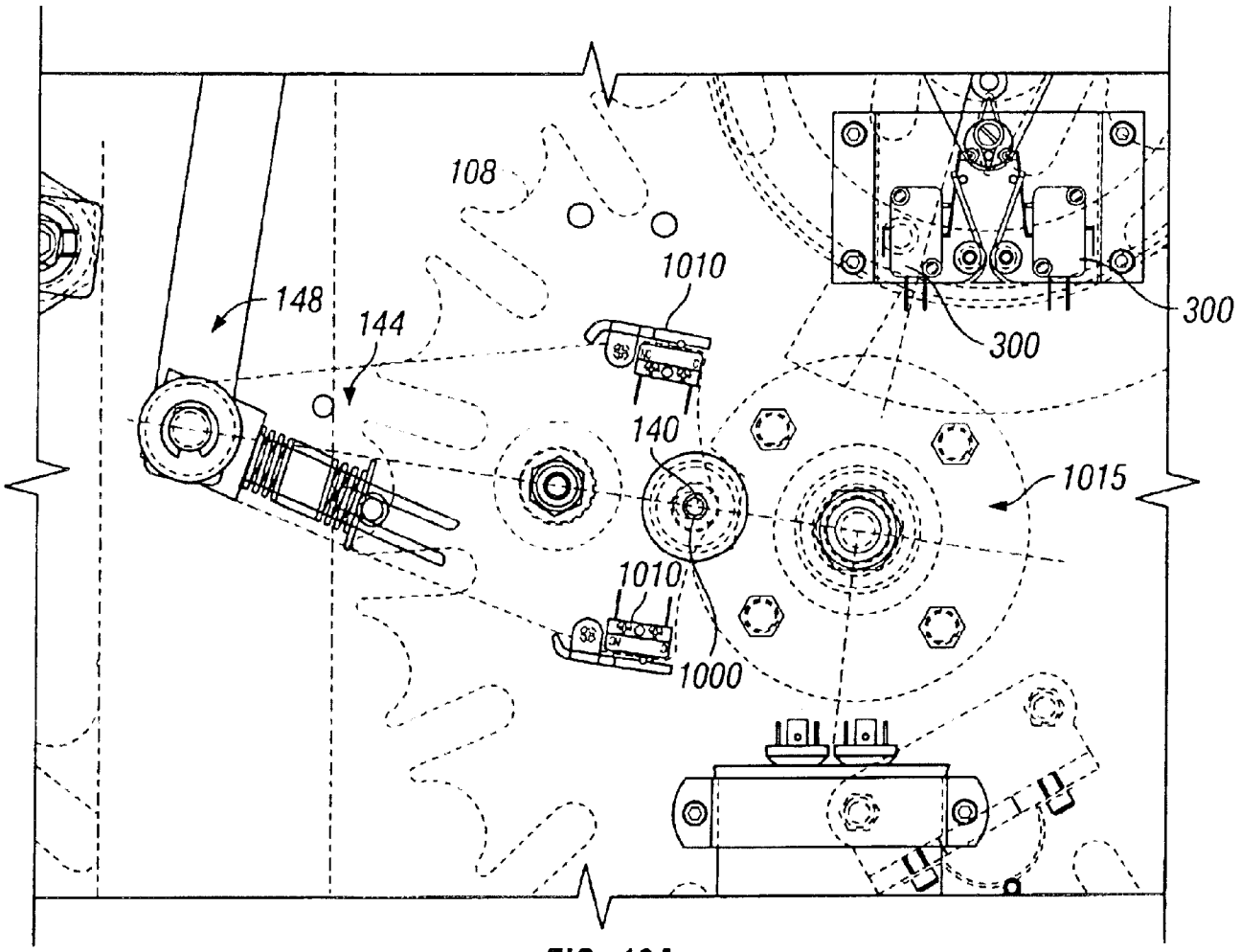
Figure 10B:
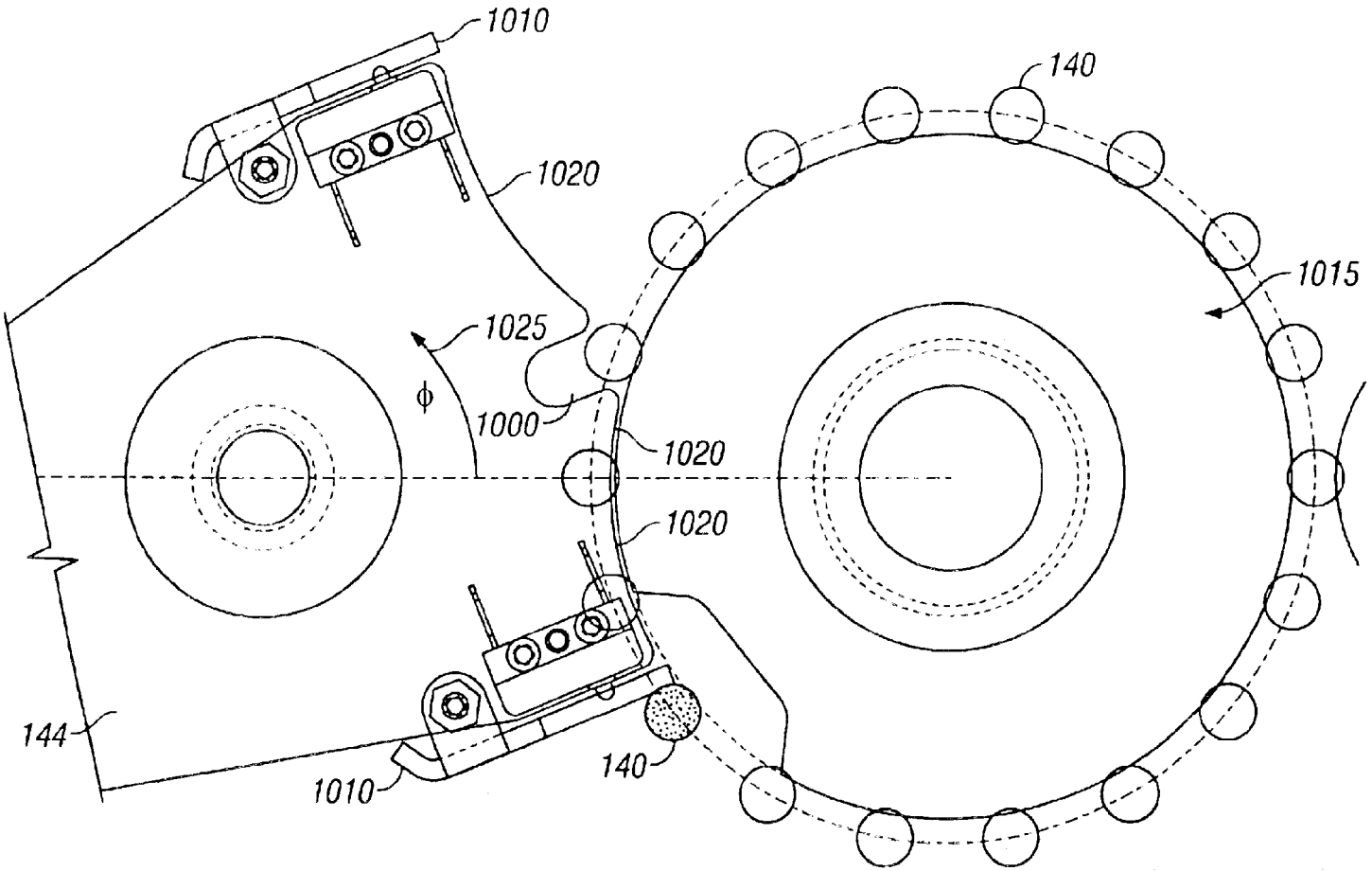
Figure 10C:
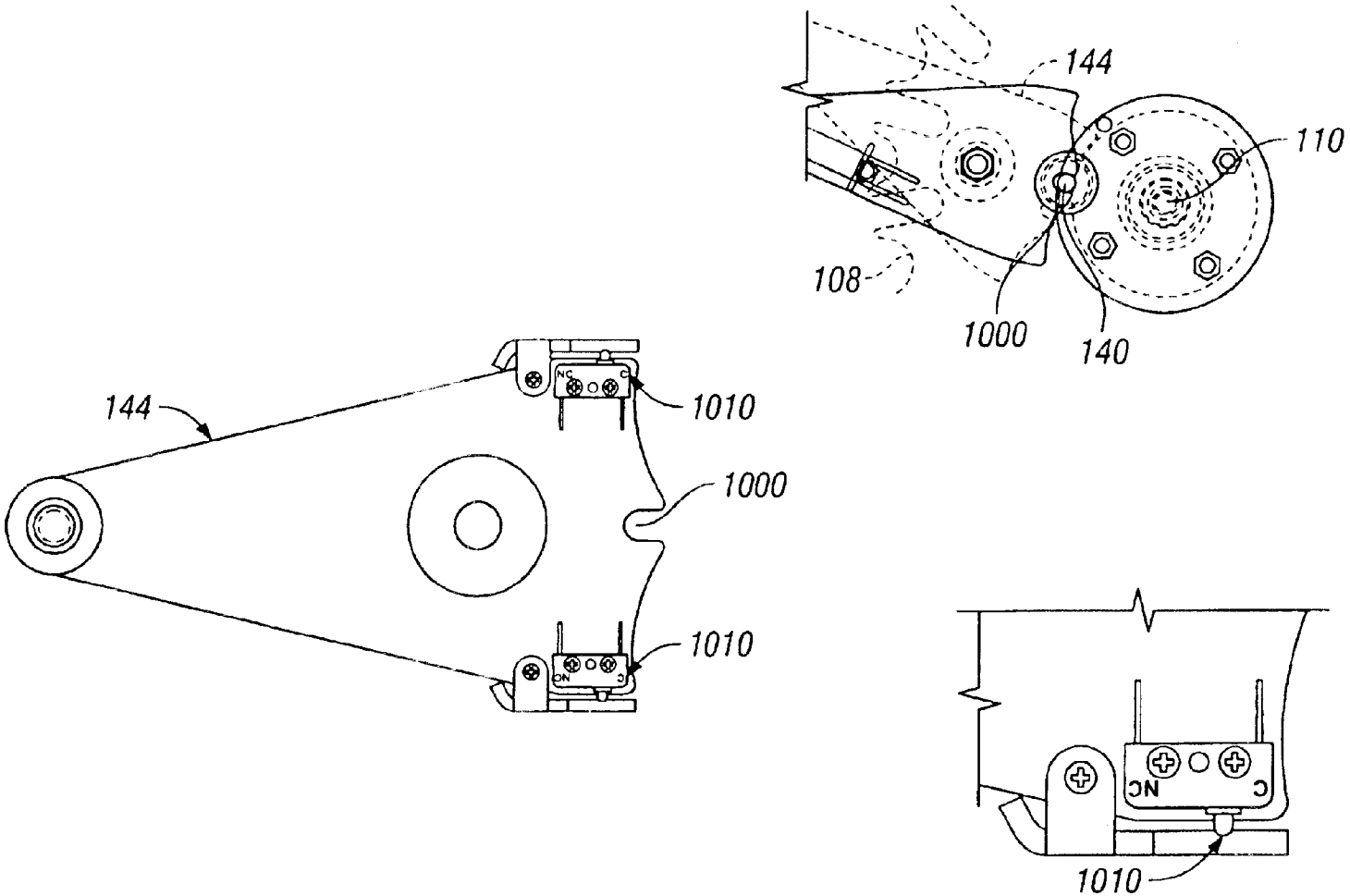

Referring also to FIGS. 10A–C, the pivoting member 144 serves the double function of actuating the reversing switch and acting as a mechanical stop to prevent travel of the geneva gear 108 past the last tap position. The pivoting member 144 has a slot 1000 that is driven by pin 140 attached to the geneva gear 108. As shown in FIG. 10A, the drive pin 140 is in a neutral position within the slot 1000. In FIG. 10B, positions of the drive pin 140 are shown in increments of 20° and the travel limit position of the drive pin 140 is shown in a shaded position.

The pivoting member 144 may support one or more safety switches 1010, which are mounted on each side of pivoting member 144. The drive pin 140 is located on a hub 1015 attached to the geneva gear 108 such that, when the movable contacts 124, 126 reach a travel limit position, the drive pin 140 depresses the safety switch 1010. At this point, the drive pin 140 has rotated to position 16L or 16R, which are the limits of the geneva gear 108. These limits are defined by a mechanical stop provided by the hub 1015 contacting curved surface 1020 of the pivoting member 144. When depressed, the safety switch 1010 trips open an electrical circuit that energizes the motor 102, thus cutting off power to the motor 102 from that circuit and preventing re-energizing of the motor 102 in the same direction.

If the safety switch 1010 fails to open the circuit when the drive pin 140 has rotated to its limiting position, the motor 102 could be energized in the same direction while the mechanical stop prevents the pivoting member 144 from rotating in direction 1025. The safety switch 1010 opens both the circuit of the holding switch 300 and the control apparatus 128 circuit to block any signal along either circuit path from reaching the motor. Without the safety switch 1010, when the pivoting member 144 reaches the mechanical stop, the holding switch 300 is closed, but the geneva gear 108 is prevented from rotating. In this case, the tap changer 100 stops moving, but the motor 102 continues to be energized through the holding switch. With the safety switch 1010, when the pivoting member 144 reaches the mechanical stop, the safety switch 1010 opens the holding switch circuit and allows the motor to rotate in an opposite direction. If both circuits were closed such that they were both energizing the motor 102 simultaneously in both directions, the fields that they produce would cancel each other out and the motor would not move in any direction.

Figure 11:
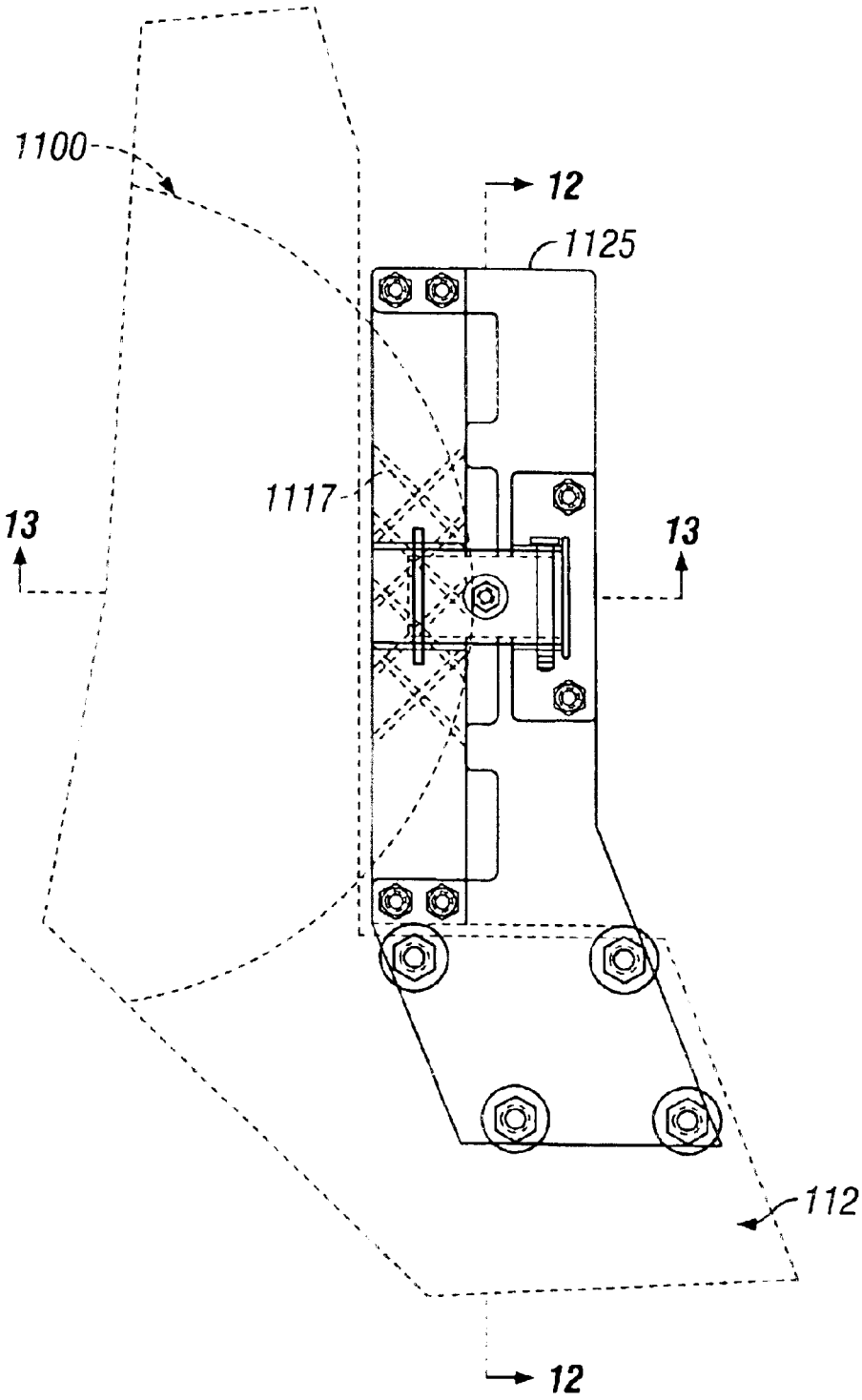
Figure 12:
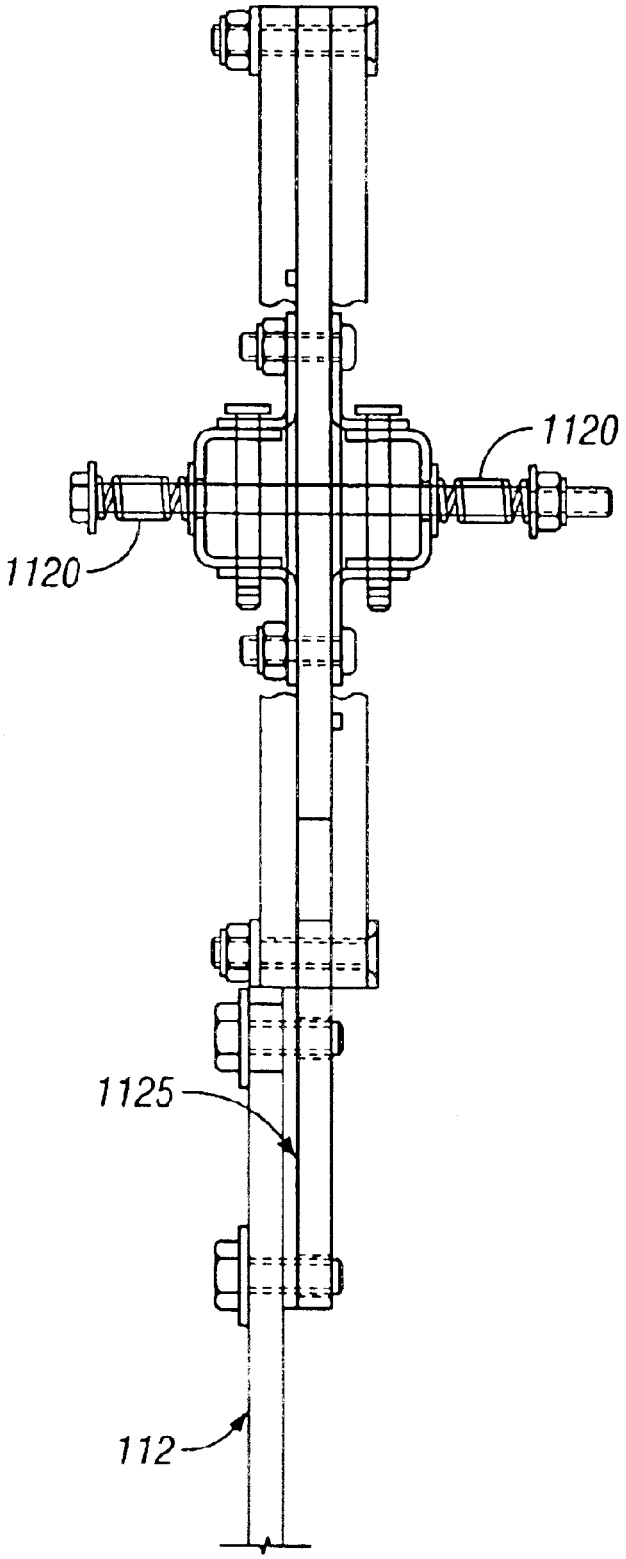
FIGS. 12 and 13 are cross-sectional views of the load tap changer of FIGS. 1A–F.
Figure 13:
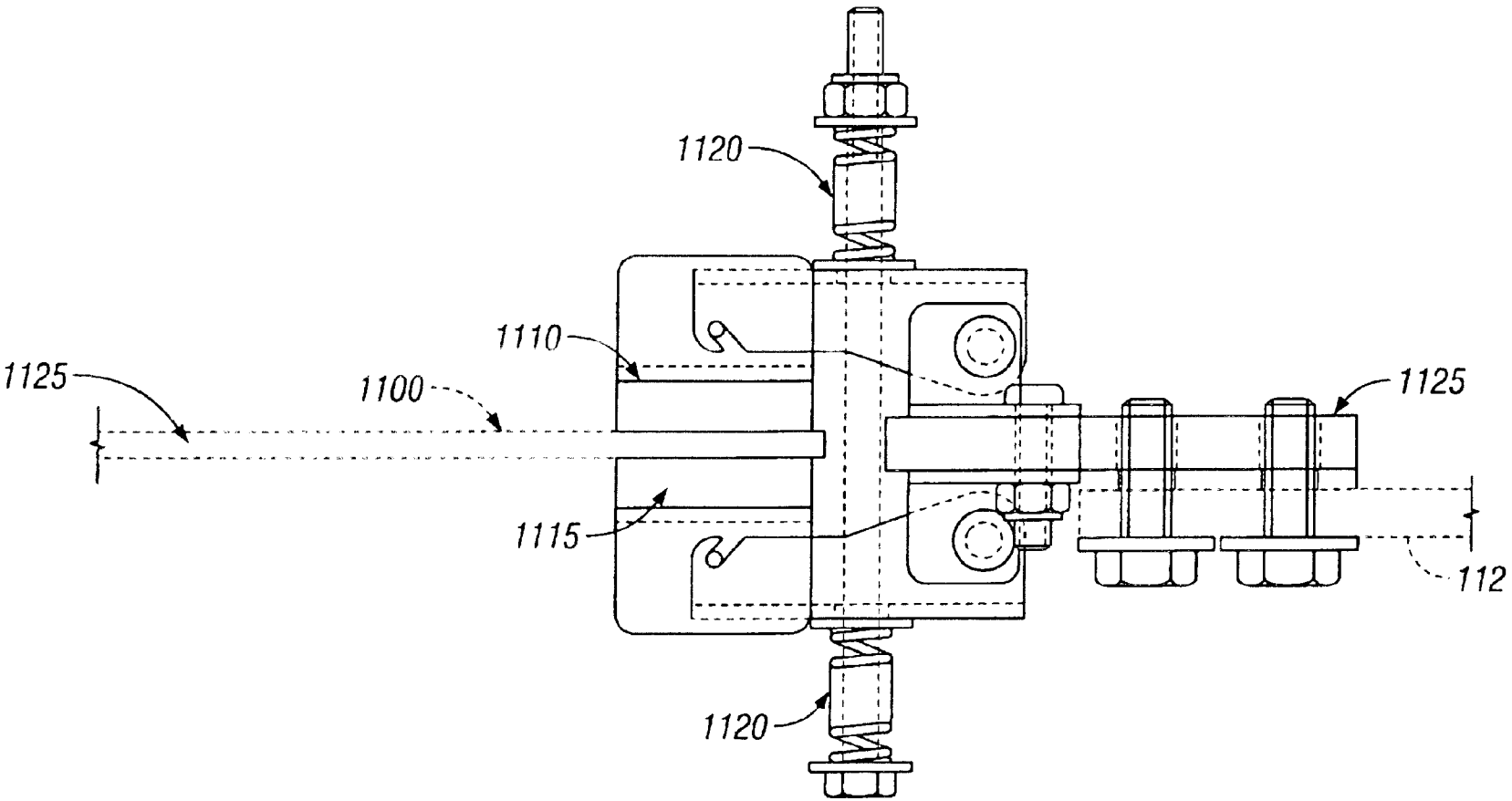

Referring also to FIGS. 11–13, the load tap changer 100 also includes a brake system that provides frictional force to stop a shaft of the motor 102 and the drive sprocket 106 after the tap change is completed. The brake system is engaged and disengaged at precise predetermined angular travel of the drive shaft 107 to provide braking action after the motor 102 is de-energized and the tap change is completed. The brake system also removes the braking force to allow free rotation of the drive during the indexing motion. The brake system includes a disc 1100 that is integral with the drive sprocket 106, rotates with the drive sprocket 106, and has a partial circular segment cut out from an outer diameter of a solid portion 1105.

The brake system includes a stationary braking assembly having two brake lining strips 1110, 115 facing each other and placed under compression by a spring force adjustable by a set of springs 1120. The brake lining strips 1110, 1115 may be made from any friction inducing material, such as, for example, cork or a cork and resin binder composite material. The brake lining strip 1110 or 1115 may have one or more grooves 1117 on its face in contact with the brake disc 1100.

The parting line between lining strips 1110, 1115 is coplanar with and centered on a bracket 1125 having a thickness of the brake disk 1100. The brake lining strips 1110, 1115 are spaced at opposite ends of the bracket 1125 and kept apart by the bracket 1125. Braking action occurs by a frictional force between the lining strips 1110, 1115 and both sides of the solid portion 1105 of the rotating brake disc 1100 when the disc travels between the lining strips 1110, 1115. The braking action is suppressed while the partial circular segment of the brake disc 1100 travels past the brake liner strips 1110, 1115 without engaging them. The plate 1125 supports the springs 1120 and the lining strips 1110, 1115, and attaches the brake system to the plate 112.

Movement of the movable contacts 124, 126 is governed by a transfer time. The transfer time is the time interval between the point at which one of the movable contacts 124 or 126 initially disengages a first stationary contact 118 and the point at which that same movable contact initially engages a second stationary contact 118 adjacent to the first stationary contact 118. The tap changer 100 is configured such that the transfer time corresponds to at least one and one half cycles at the given alternating current power frequency. The electric arc established immediately after contact is broken between the movable contact 124 or 126 and a stationary contact 118 can be interrupted only at a current zero. The one and one half cycle transfer time insures that at least three current zeros occur during the transfer time. Interrupting the arc before contact is made between the movable and stationary contacts is necessary to prevent a short circuit from being established between adjacent stationary contacts through the arc.

Figure 14A:
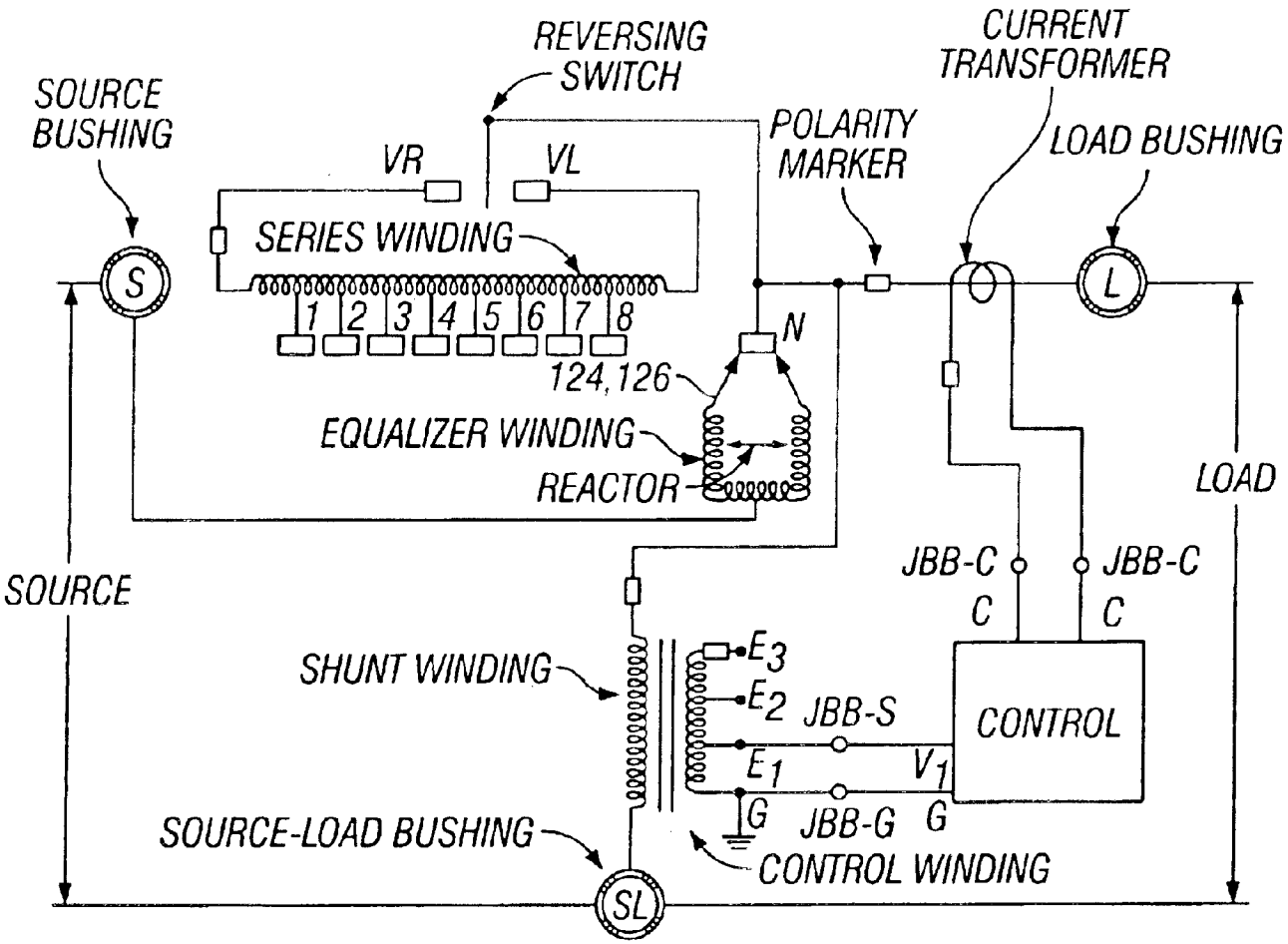
FIG. 14A is a circuit diagram of the load tap changer implemented in a power system across a series winding located on the source side.
Figure 14B:
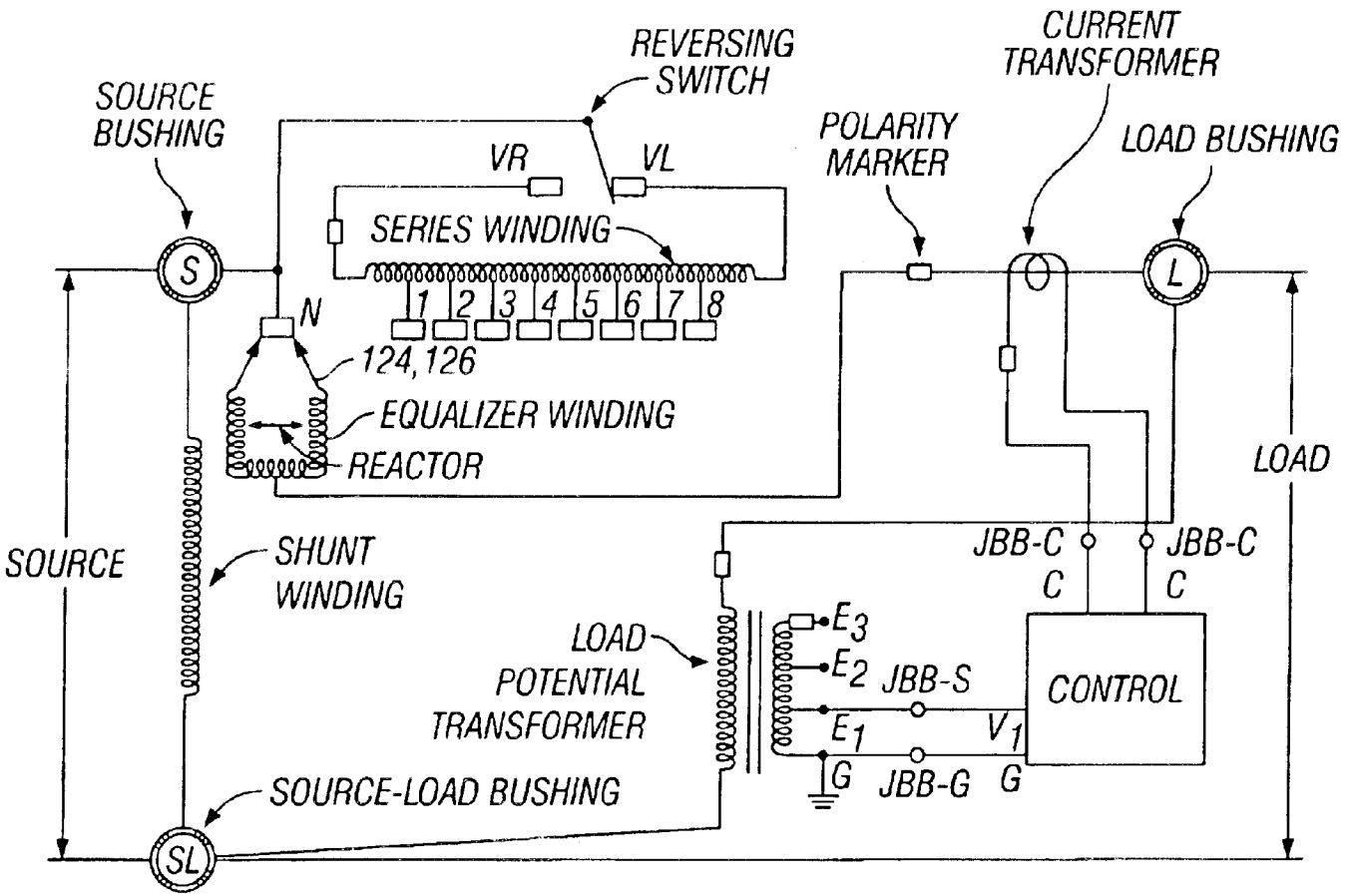
FIG. 14B is a circuit diagram of the load tap changer implemented in a power system across a series winding located on the load side.
Figure 14C:
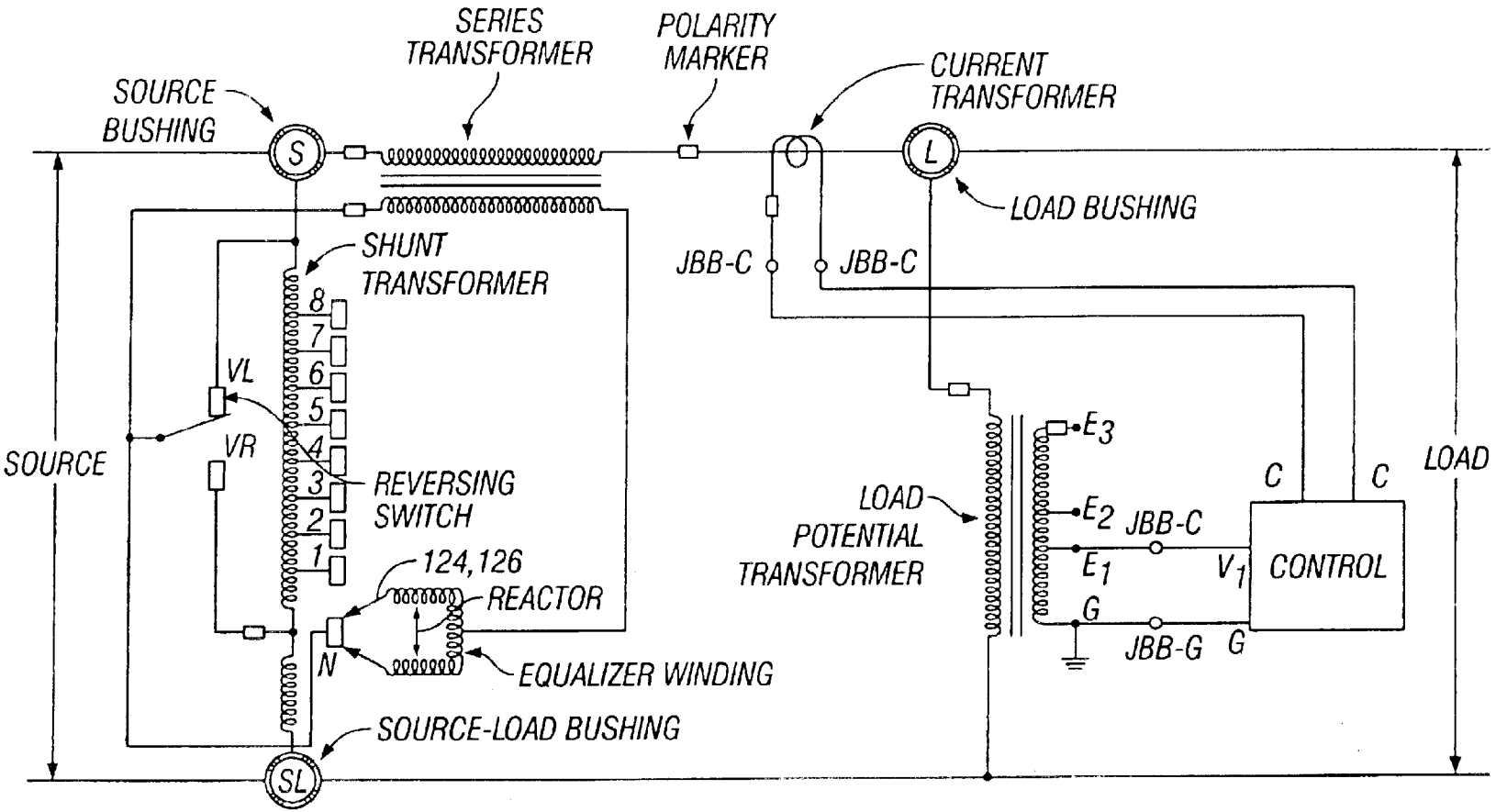
FIG. 14C is a circuit diagram of the load tap changer implemented in a power system across a shunt winding.

Referring also to FIGS. 14A–C, the tap changer 100 may be implemented in circuits 1400, 1405, 1410 that control the transfer of voltage from a source to a load. As shown, the tap changer 100 may include a split switching reactor, thus enabling, for example, 16 steps for each reversing switch position for a tap changer connected to eight tap of the electronic control device winding.

Figure 15A:
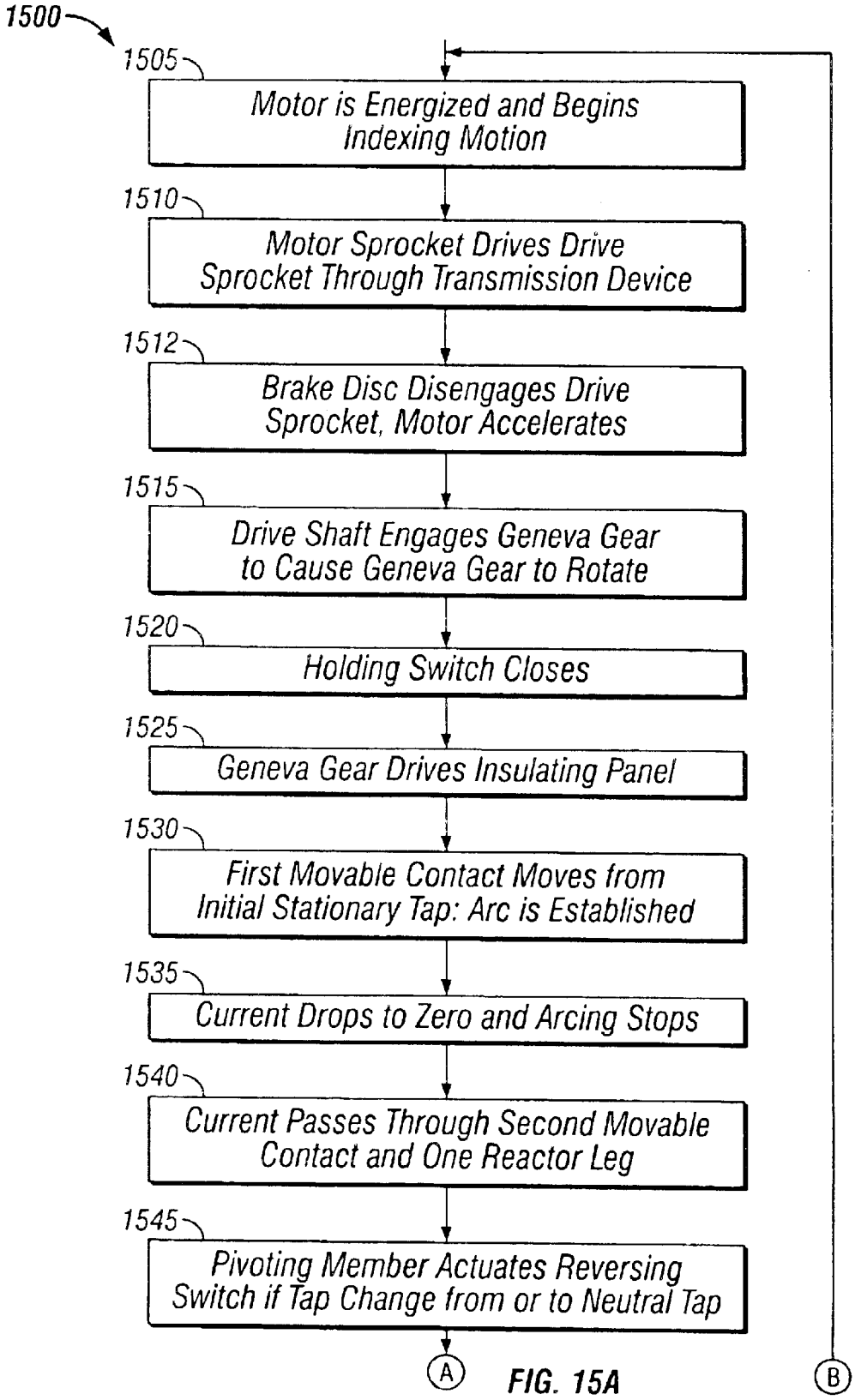
FIG. 15 is a flow chart of a procedure implemented by the load tap changer of FIGS. 1A–F.
Figure 15B:
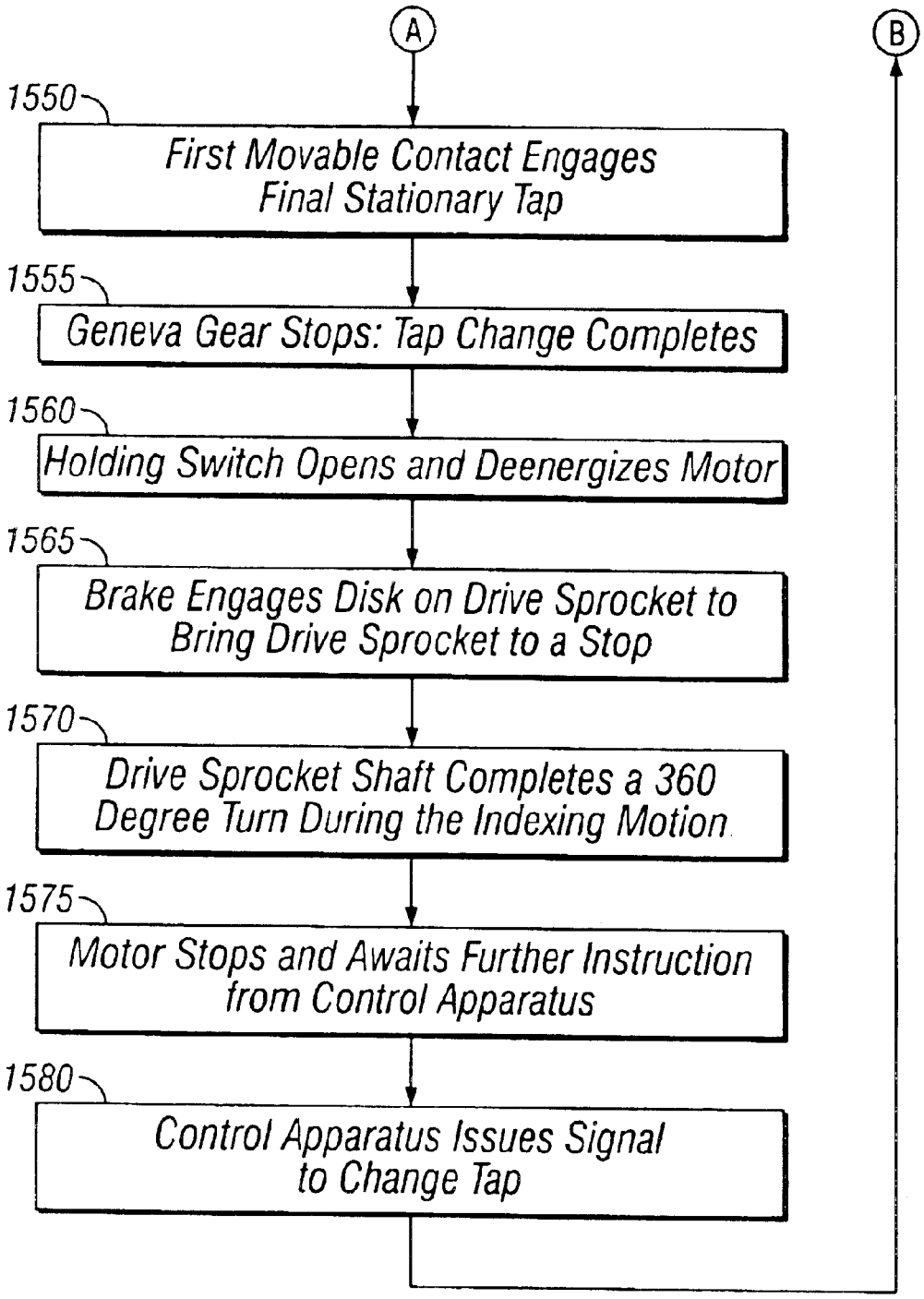

Referring also to FIG. 15, the tap changer 100 performs a procedure 1500 for transferring the movable contacts 124, 126 from a first stationary contact 118 (which may be the neutral tap contact 127) to a second stationary contact 118. Initially, the motor 102 is energized and the sprocket 104 begins to turn (step 1505). The motor sprocket 104 drives the drive sprocket 106 through the chain 105 (step 1510) against the friction applied by the brake. The brake disc 1100 disengages the drive sprocket 106 and the motor 102 accelerates, thus permitting the motor torque to be used to drive the geneva gear 108 (step 1512). Then, drive shaft 107 engages the geneva gear 108 to cause the geneva gear to rotate (step 1515).

The holding switch 300 closes to provide continuous electrical power to the motor 102 and to ensure the completion of a tap change (step 1520). The geneva gear drives the insulating panel 122 (step 1525) such that a first movable contact (for example, 124) moves from an initial stationary contact to establish an arc (step 1530). The current to the load drops to zero and arcing stops (step 1535). Then, current passes through the second movable contact (for example, 126) and one reactor leg coupled to the second movable contact (step 1540).

If the tap changer is about to move to or from the neutral position (that is defined by neutral tap contact 127), then the pin 140 slides into engagement with the pivoting member slot 1000 to cause the pivoting member 144 to move, and actuate the linkages 148, 150 and the reversing switch (step 1545). In this case, one of the two movable contacts 124, 126 moves either in or out of engagement with the neutral tap contact 127. While in transit, after interrupting current to the load 132 and while both contacts 124, 126 are on the neutral tap contact 127, 162, no current is carried by the movable contacts 124, 126. The load current bypasses the tapped section of the winding and flows to the load 132. The reversing switch carries no current so it can move without interrupting the load current. The linkages 148, 150 drive the movable contacts 154, 156 to pivot about axis 158, thus forming a bridge between the neutral tap contact 127 and one of the stationary contacts 160 or 164, connected to each end of the winding tapped section. This design prevents arcing across the movable contacts 154, 156 and the stationary contact 162.

Next, the second movable contact (for example 126) slides over and engages the final stationary contact (step 1550). The drive shaft 107 disengages the geneva gear 108, the geneva gear 108 stops moving and is rotationally locked to complete a tap change (step 1555). The holding switch 300 opens and de-energizes the motor 102 (step 1560). As the brake disc 1100 passes through the lining strips 1110, 1115, the brake disc 1100 is engaged and the drive sprocket 106 is slowed to a stop at mid travel (step 1565). The shaft of the drive sprocket completes a 360° turn (step 1570). The motor shaft also stops and then awaits further instruction from the control apparatus 128 (step 1575). The control apparatus 128 issues a signal to change or select another tap of the electronic control device winding (step 1580).

Other implementations are within the scope of the following claims. For example, the motor 102 may be designed with another output device such as a pinion (instead of a sprocket 104). In this design, the transmission device may be a spur gear that meshes with the motor pinion and is mounted to or is integral with the drive shaft 107. Thus, movement of the motor output shaft causes the pinion to turn the spur gear, which rotates the drive sprocket 106.

What is claimed is:

1. A method of selecting a tap connected to an electrical control device for controlling voltage from a power source to a load, the method comprising:

receiving a signal from a control apparatus coupled to the power source to select a tap;

energizing a motor coupled to the control apparatus and having an output device;

rotating the motor output device in response to the energization of the motor;

providing a transmission device coupled to the motor output device and to a drive sprocket;

driving the drive sprocket through the transmission device in response to rotation of the motor output device;

rotating a gear in response to driving the drive sprocket, the gear engaging a first set of movable contacts;

rotating the first set of movable contacts in response to rotation of the gear to select the tap connected to the electrical control device.

2. The method of claim 1 further comprising closing a holding switch connected to couple the power source to the motor to maintain continuous power to the motor from the power source to ensure that the tap is selected after the signal from the control apparatus is received.

3. The method of claim 2 further comprising opening the holding switch after a predetermined rotation of the drive shaft to de-energize the motor to select the electrical control device tap.

4. The method of claim 1 further comprising actuating a pivoting member coupled to the gear to change a polarity of the voltage through the tapped section of the electrical control device.

5. The method of claim 4 further comprising forming an anti-arcing bridge between a neutral tap and a second set of movable contacts connected to one end of a winding of the electrical control device.

6. The method of claim 5 further comprising de-energizing the motor when the first set of movable contacts reaches a travel limit position.

7. The method of claim 1 further comprising engaging the drive sprocket to prevent the drive sprocket from moving when the electrical control device tap is selected.

8. The method of claim 1 further comprising actuating a device remote from the motor and the gear to indicate the selected electrical control device tap.

9. The method of claim 8 in which actuating the remote device comprises engaging a second gear by an output shaft of the drive sprocket to rotate a pinion coupled to the remote device.

10. The method of claim 9 further comprising stabilizing the second gear with a biasing device attached to the pinion and engaging a slot along an outer perimeter of the second gear.

* * * * *